US005182427A

United States Patent [19]

McGaffigan

[11] Patent Number: 5,182,427

[45] Date of Patent: Jan. 26, 1993

[54] SELF-REGULATING HEATER UTILIZING FERRITE-TYPE BODY

[75] Inventor: Thomas H. McGaffigan, Half Moon Bay, Calif.

[73] Assignee: Metcal, Inc., Menlo Park, Calif.

[21] Appl. No.: 586,865

[22] Filed: Sep. 20, 1990

[51] Int. Cl.[5] ..... H05B 6/10

[52] U.S. Cl. ..... 219/10.75; 219/9.5; 219/10.57; 219/85.11; 219/553; 219/494

[58] Field of Search ..... 219/10.75, 9.5, 10.41, 219/10.43, 10.57, 85.1, 85.11, 552, 553, 503, 510, 494, 495

[56] References Cited

U.S. PATENT DOCUMENTS

| | | | |
|---|---|---|---|
| T905,001 | 12/1972 | Day | 264/25 |
| 2,397,348 | 3/1946 | Haines et al. | 219/26 |
| 2,836,694 | 5/1958 | Emerson | 219/10.41 |
| 3,191,132 | 6/1965 | Mayer . | |
| 3,309,633 | 3/1967 | Mayer . | |
| 3,391,846 | 7/1968 | White | 229/17 |
| 3,470,046 | 9/1969 | Verdin | 156/86 |
| 3,632,943 | 1/1972 | Engler | 219/10.79 |
| 3,651,299 | 3/1972 | O'Neill | 219/10.53 |
| 3,943,323 | 3/1976 | Smith et al. | 219/85 |
| 4,035,547 | 7/1977 | Heller, Jr. et al. | 428/329 |
| 4,139,408 | 2/1979 | Kobetsky | 156/380 |
| 4,248,653 | 2/1981 | Gerber | 156/272 |
| 4,256,945 | 3/1981 | Carter et al. | 219/10.75 |
| 4,347,487 | 8/1982 | Martin | 333/1 |
| 4,355,222 | 10/1982 | Geithman et al. | 219/10.57 |
| 4,499,438 | 2/1985 | Cornelius et al. | 333/1 |
| 4,555,422 | 11/1985 | Nakamura et al. | 428/36 |
| 4,659,912 | 4/1987 | Derbyshire | 219/535 |
| 4,699,743 | 10/1987 | Nakamura et al. | 264/104 |
| 4,701,587 | 10/1987 | Carter et al. | 219/10.75 |
| 4,745,264 | 5/1988 | Carter | 219/553 |
| 4,788,404 | 11/1988 | Kent | 219/85 R |
| 4,789,767 | 12/1988 | Doljack | 219/9.5 |
| 4,814,546 | 3/1989 | Whitney et al. . | |
| 4,839,501 | 6/1989 | Cowell | 219/237 |
| 4,849,611 | 7/1989 | Whitney et al. | 219/538 |
| 4,877,944 | 10/1989 | Cowell et al. | 219/548 |
| 4,914,267 | 4/1990 | Derbyshire | 219/85.1 |

FOREIGN PATENT DOCUMENTS

| | | |
|---|---|---|
| 41-2677 | 4/1966 | Japan . |
| 1076772 | 7/1967 | United Kingdom . |

OTHER PUBLICATIONS

Brailsford, *Magnetic Materials,* (1960).

Lee, E. W., *Magnetism, An Introductory Survey,* (1970) pp. 201-204.

Murakami, K., *IEEE Transactions on Magnetics,* (Jun. 1965) pp. 96-100.

Smit et al., *Ferrites,* (1959) pp. 155-160.

*Primary Examiner*—Philip H. Leung

*Attorney, Agent, or Firm*—Burns, Doane, Swecker & Mathis

[57] ABSTRACT

A self-regulating heater is provided by placing ferrite-type body member, which is highly lossy when exposed to a high frequency magnetic field and has a predetermined Curie temperature, on or around a central conductor which is connected or is adapted to be connected to a power source which provides high frequency alternating current to the conductor. The current passing through the central conductor produces a magnetic field around the conductor, which causes the ferrite-type body to be heated by internal losses to its Curie temperature. The heater self-regulates at the Curie temperature of the ferrite-type body. The power source is preferably a constant current, impedance matched power source. The ferrite-type body member can be ferromagnetic or ferrimagnetic. The ferrite-type body is preferably ferrimagnetic, such as ferrite beads, rings, and the like, which heat by hysteresis losses.

42 Claims, 8 Drawing Sheets

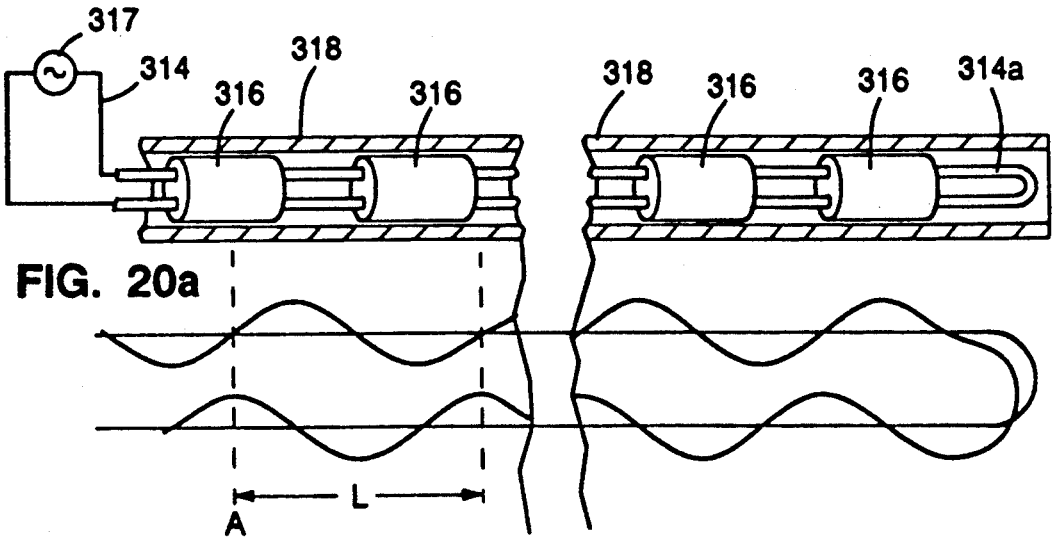
FIG. 20a
FIG. 20b
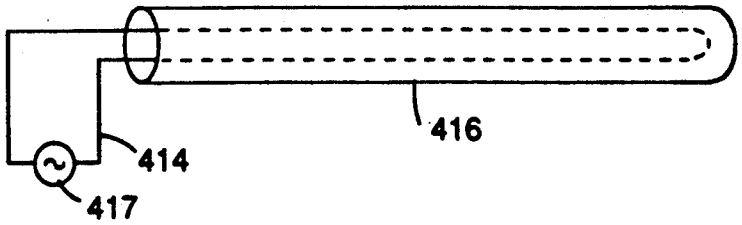
FIG. 21
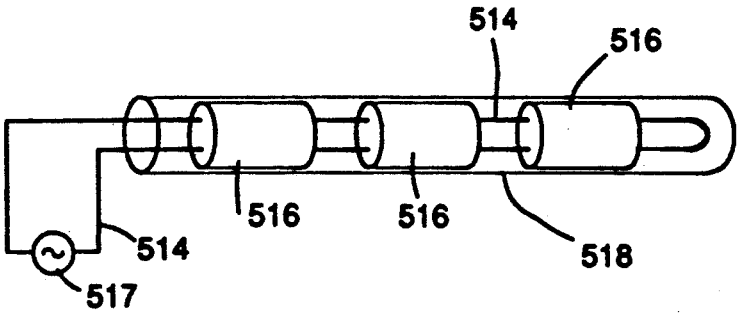
FIG. 22

SELF-REGULATING HEATER UTILIZING FERRITE-TYPE BODY

FIELD OF THE INVENTION

This invention relates to self-regulating heaters having substantially constant temperature regulation, high efficiency and high watt-density.

BACKGROUND OF THE INVENTION

This invention relates to devices and methods that employ ferrite-type materials to produce heat in an alternating magnetic field. Ferromagnetic materials and ferrites have been used in various systems and devices for heat producing purposes and for non-heat producing purposes. Ferrite powders have been used to produce heat by hysteresis losses and/or skin effect eddy current losses when placed in an electromagnetic field provided by an induction coil powered by an alternating current power source. Ferromagnetic materials have been used in layers to produce heat from skin effect losses when powered by an alternating current.

The use of ferrites and ferromagnetic materials to produce heat by induction heating is illustrated in U.S. Pat. No. 3,391,846 to White et al., wherein antiferromagnetic particles, such as a ferrite powder, are used to produce heat where it is desirable to cause chemical reactions, melt materials, evaporate solvents, produce gasses and for other purposes. In White et al., a material containing the nonconductive antiferromagnetic particles was passed through or near an induction coil thus subjecting them to a high frequency alternating magnetic field of at least 10 MHz, thereby heating the particles to their Néel temperature.

In Japanese Kolsoku Disclosure No. 41-2677 (Application No. 39-21967) a ferrite material is placed inside an induction coil and heated by a high frequency alternating current. Objects, such as fibers, are then passed through openings in the ferrite material to heat treat by conduction the objects at the Curie temperature of the ferrite material.

In co-pending U.S. application Ser. Nos. 07/404,621 filed Sep. 8, 1989, 07/465,933 filed Jan. 16, 1990, and 07/511,746 filed Apr. 20, 1990, all hereby incorporated herein by reference, various devices and methods are disclosed utilizing ferrite powder and similar ferromagnetic or ferrimagnetic materials in the magnetic field of an induction coil to produce improved and effective heating in particular applications. Application Ser. No. 07/404,621 discloses auto-regulating, self-heating recoverable articles which, when subjected to an induction coil alternating magnetic field, heat to the Curie temperature of the particles by induction heating to generate sufficient heat to cause the heat recoverable articles to recover to their original configuration. U.S. application Ser. No. 07/465,933 discloses a system for providing heating in an article or object in an induction coil alternating magnetic field using lossy, heat producing magnetic particles in combination with non-lossy particles which have high permeability and which are not heat producing particles. The non-lossy particles serve to maintain the coupling of the magnetic circuit and maintain the desired magnetic field focus and intensity through the area in which the lossy heat producing particles are positioned. U.S. application Ser. No. 07/511,746 discloses a removable heating article for use in an alternating magnetic field created by an induction coil in which a base material carries lossy heating magnetic particles. The article can be attached to a substrate and removed therefrom after being subjected to the magnetic field created by an induction coil and after the heating is completed.

Ferromagnetic materials have also been used in heating devices that employ the skin effect heating phenomenon to provide self-regulating heating devices. For example, U.S. Pat. Nos. 4,256,945 and 4,701,587, both to Carter and Krumme, disclose a self-regulating heater such as a soldering iron tip, which consists of an outer nonmagnetic shell which is in good thermal and electrical contact with an inner ferromagnetic shell or layer. An inner conductive, nonmagnetic stem extends axially into the assembly formed by the inner and outer shells, and may be joined to the inner shell. A power supply is connected to the stem and the outer shell. A self-regulating soldering iron is achieved by the selection of a ferromagnetic material having a Curie temperature above the melting point of the solder. When high frequency, constant current power is applied between the stem and the outer shell, current flows primarily in the ferromagnetic material and produces heat due to the skin effect resistance losses. When the device approaches Curie temperature, the ferromagnetic material becomes nonmagnetic and the current flows primarily in the copper outer shell. Since the current is constant and the copper has substantially less electrical resistance than the ferromagnetic material,. heating is greatly reduced while the ferromagnetic layer is at or above its Curie temperature. As a consequence, the temperature of the device is regulated near the Curie temperature of the ferromagnetic material chosen.

U.S. Pat. No. 4,914,267 to Derbyshire also discloses skin effect type heaters which use ferromagnetic materials having a desired Curie temperature in electrically conductive layers to provide auto-regulated heating to the Curie temperature of the material upon application of an alternating current to the conductive layer of ferromagnetic material. The power applied to the ferromagnetic layer is in the form of an alternating current which produces skin effect current heating in the continuous ferromagnetic layer. As the ferromagnetic layer reaches its Curie temperature, the permeability of the layer drops and the skin depth increases, thereby spreading the current through the wider area of the ferromagnetic layer until the Curie temperature is achieved throughout and the desired heating is achieved. The alternating current is supplied to the ferromagnetic layer either directly from a power source through electrodes in the conductive layer of ferromagnetic material or is supplied inductively from an adjacent insulated conductive layer directly powered with the alternating current. Another type of auto-regulating skin effect type heater is disclosed in U.S. Pat. No. 4,659,912 to Derbyshire in the form of a flexible strap heater which includes a ferromagnetic layer.

In U.S. Pat. No. 4,745,264, Carter discloses a self-regulating heater in which inductive coupling is employed to couple a constant current into a ferromagnetic layer surrounding and contacting a copper rod forming a rearward extension of the tip of the soldering iron. The induction coil employed to couple current into the magnetic material surrounds the layer of conductive ferromagnetic material.

U.S. Pat. No. 4,839,501 to Cowell illustrates another example of such a self-regulating cartridge soldering iron having a replaceable tip. The cartridge includes a helical induction coil wound around a tip extension rod having a layer of high Mu ferromagnetic material.

In U.S. Pat. No. 4,877,944, Cowell et al. disclose another self-regulating heater in which the core is shaped so as to focus the magnetic flux in the layer of ferromagnetic material of the heater. The core may be "I" or "E" shaped in cross-section and has a coil wound about its narrow section(s). Also, it is disclosed that an outer magnetic layer is disposed outside the coil to act as a magnetic shield and restrict spreading to the magnetic flux.

In art areas unrelated to heating devices, ferrimagnetic materials and in particular ferrites in the form of beads, blocks, rings, etc. are conventionally placed on electrical conductors to provide various functions, such as RF/EMI shielding, signal isolation, noise suppression, transient filtering, oscillation damping, high frequency filtering or damping, and the like. However, these prior conventional uses of ferrite bodies do not produce significant heat in the ferrite body. While the filtering or damping function provided by a ferrite body may incidentally convert the filtered signal or frequency to a small amount of heat, the amount of heat produced is insignificant or inconsequential in the device or in the environment where the ferrite body provides the desired filtering or damping function. In fact, it has been recognized in the art that even significant heat, especially excessive heat, is to be avoided in such systems because such heat would unduly heat nearby electrical components and interfere with the function of the circuit or device.

While the heating devices described above are useful and have certain advantages in various applications compared to other devices, they also have certain disadvantages, particularly with respect to other applications. The devices comprising induction coils require high temperature wire insulation with small gauge wire to achieve the small size of the heater device desired for many heater or soldering iron tip applications. Due to the small gauge of the wire, the current capacity is limited, as is the output power of the device. Also, the necessity of having the induction coil present to provide the required magnetic field limits the configurations in which the heater device can be made.

The skin effect, eddy current, layer type heater devices are likewise very effective and have certain advantages in many applications, but have certain disadvantages with respect to certain other applications. For example, the power or current capacity, and the heat producing capacity, are sometimes limited by the capacity of the layers in the device. In addition, these ohmically connected devices are typically low in impedance and require bulky, inefficient and high current capacity impedance matching networks.

In still other art areas also unrelated to heaters, ferrite bodies, such as beads, have also been used as sensors, switches, fuses and controls in various electrical circuits. These uses primarily utilize the Curie temperature effect of a ferrite body. For example, a ferrite bead is placed on a conductor in a particular electrical circuit and the presence of the bead provides a certain impedance and/or resistance in that part of the circuit. When the ambient or surrounding environment temperature raises the temperature of the ferrite body above its Curie temperature, the ferrite body experiences a sharp loss in magnetic permeability. This loss of magnetic permeability by the bead causes a change in the characteristic of the circuit, thus signaling some other part of the circuit that the specified ambient temperature or surrounding environment has been reached.

In the heater device art ferrite bodies have been used as sensor/control elements. An example of such sensor/control use of ferrite bodies in a heated device is illustrated in U.S. Pat. No. 4,849,611 to Whitney et al., which relates to a self-regulating heater. The embodiments disclosed at FIGS. 12*c* and 19*a* include a number of ferrite beads strung on a conductive wire (together referred to therein as the reactive component), which is connected in parallel to a resistance heater member or element. When a current is applied, the resistance heating element produces heat, which heats the ferrite beads by conduction, convection and/or radiation. When the ferrite beads are thus heated by the heat generated by the resistance heater element to their Curie temperature, their magnetic permeability sharply decreases. Thus, the reactive component of the circuit containing the ferrite beads is a temperature-responsive sensor part of the circuit. When the magnetic permeability of the ferrite beads drops at their Curie temperature, this allows the reactive component to change the parallel circuit balance so that the current flow through the resistive heating component is decreased. When the device cools so that the ferrite beads cool below their Curie temperature, their magnetic permeability increases, thereby increasing the current flow through the resistance heater element and causing increased heating to again occur in the resistance heater element. This parallel circuit arrangement allows regulation of the temperature of the resistive heater element at the Curie temperature of the adjacent ferrite beads. The ferrite bead elements in that circuit thereby function in their conventional manner to act as temperature sensor/circuit control. In that device the ferrite beads do not produce any significant heat themselves, as evidenced by the parallel circuit arrangement and by the low frequency power supply utilized.

The resistive heating element/reactive-control element type of heater devices have disadvantages associated with the fact that the resistive heating element and the reactive-control element must be in thermal contact or proximity, which restricts the size of the total heating device making it unsuitable for many applications. Also, the temperature of the reactive-control component lags behind the temperature of the heat generating component resulting in undesired temperature oscillation instead of the desired self-regulation at a constant temperature. In addition, thermal resistance between the resistance heater and the ferrite sensor elements is high; because of this the thermal response of the heater to changing thermal loads is poor.

In view of the above, it is apparent that there is a need for improved self-regulating heaters. The present invention has been developed to provide self-regulating heaters and methods for making and using heaters which have various advantages and which do not have the disadvantages mentioned above.

Therefore, it is an object of this invention to provide a self-regulating heater which provides efficient heat generation without the use of layers or skin effect, eddy current heating.

It is a further object of the present invention to provide a self-regulating heater which does not require the presence of a multiple turn, wire coil or an induction coil and associated high temperature electrical insulation for the coil wire.

It is a further object of the present invention to provide a self-regulating heating device that can be made in small sizes having a high watt-density and high power capability.

It is a further object of this invention to provide a self-regulating heater which does not require separate elements or components for heating and for sensing-/control to provide self-regulation.

It is a further object of the present invention to provide a self-regulating heater which is inexpensive, easy to manufacture and which can be made in any configuration desired for applying or distributing heat to a desired object or material.

It is a further object of the present invention to provide a self-regulating heater which has an inherent high impedance for easier impedance matching with high frequency, alternating current power sources.

It is a further object of the present invention to provide a self-regulating heater which has a high switching ratio and a quick response time.

The above, as well as other objects, are achieved by the present invention as will be recognized by one skilled in the art from the following summary and description of this invention.

SUMMARY OF THE INVENTION

The present invention is in principle best understood as based on the use of ferrite-type bodies as self-regulating heat producing elements to provide self-regulating heating devices. This is made possible according to the present invention by positioning a ferrite-type body having a Curie temperature, Tc, on or around a conductor, then providing sufficient power to the conductor from an alternating current power source at sufficiently high frequency to cause the ferrite-type body present in the magnetic field around the conductor to heat by internal losses to its Curie temperature, Tc. This heater will self-regulate at the Curie temperature of the ferrite-type body. The internal losses can be either hysteresis losses, eddy current losses or both. A typical and preferred power source is a constant current power source having a preferred frequency in many applications of at least about 10 MHz.

Having thus basically summarized this invention, it is further summarized as follows.

In one aspect, this invention comprises a self-regulating heating device comprising:

central conductor means for carrying a high frequency alternating current and producing a magnetic field around the exterior thereof;

a power supply connected to the central conductor means for supplying the high frequency alternating current to the conductor means; and a ferrite-type body having a Curie temperature, Tc, positioned in the magnetic field of the central conductor means and being sufficiently lossy to be capable of producing sufficient heat by internal losses in said magnetic field to raise the temperature of the ferrite-type body to Tc;

whereby the heating device is self-regulating at Tc when powered by said power supply at a sufficiently high frequency to cause the ferrite-type body to heat to Tc by internal losses.

In another aspect, this invention comprises a self-regulating heater device comprising:

central conductor means for carrying a high frequency alternating current and producing a magnetic field around the exterior thereof;

a ferrite-type body having a Curie temperature, Tc, positioned in the magnetic field of the central conductor means and being sufficiently lossy to be capable of producing sufficient heat by internal losses in said magnetic field to raise the temperature of the ferrite-type body to Tc; and connector means adapted for electrically connecting said central conductor means to a high frequency alternating current power supply capable of causing the ferrite-type body to heat;

whereby the heater device heats to Tc and self-regulates at Tc when powered by said power supply at a sufficiently high frequency to heat ferrite-type body to Tc by internal losses.

In another aspect, this invention comprises a method of providing self-regulating heating of a substrate or material comprising the steps of:

positioning a heater device in thermal proximity to the substrate or material to be heated, wherein the device comprises a ferrite-type body having a central conductor means positioned in the ferrite-type body, having a Curie temperature, Tc, and being capable of producing heat by internal losses in an alternating magnetic field to raise the temperature of the ferrite-type body to Tc;

applying a high frequency alternating current to said central conductor means to produce an alternating magnetic field around the central conductor wherein the frequency is sufficiently high to cause the ferrite-type body to heat to Tc in the magnetic field of the central conductor means.

In another aspect, this invention comprises a soldering iron tip adapted to melt solder, said soldering iron tip comprising:

at least one heating member formed of a ferrite-type body which is sufficiently lossy when exposed to a magnetic field having a frequency sufficiently high to cause heating of the body by internal losses and which has a predetermined Curie temperature higher than the melting point of the solder; and a central conductor means positioned in the ferrite-type body and adapted to be connected to a power source for providing said high frequency current through said conductor, producing said magnetic field around the central conductor and heating said ferrite-type body to its Curie temperature.

BRIEF DESCRIPTION OF THE DRAWINGS

FIGS. 20A and 20B illustrate an elongate ferrite heater embodiment according to the present invention and the current distribution versus length to eliminate cold points in an elongate heater due to the alternating current wave length.

FIG. 21 illustrates an elongate ferrite heater embodiment according to the present invention utilizing ferrite powder.

FIG. 22 illustrates another embodiment of an elongate heater according to the diverse capability of the present invention.

DESCRIPTION OF THE INVENTION

Figure 1:
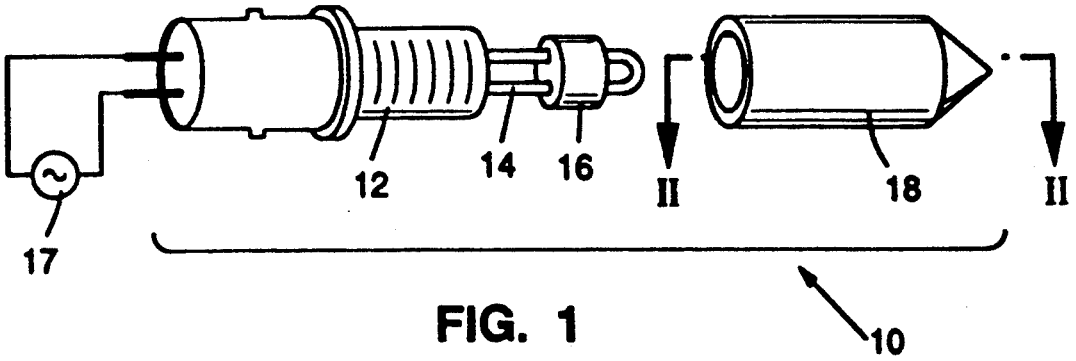
FIG. 1 illustrates an expanded view of a preferred embodiment of a soldering iron according to the present invention.

This invention is in part based on the recognition that a very high watt-density self-regulating heating device can be constructed very simply and compactly from only three components. The first component is a central conductor for carrying a high frequency alternating current. The second element is a high permeability highly lossy ferrite-type body having a desired or preselected Curie temperature, which is positioned around or adjacent to the central conductor and in the alternating magnetic field present around the central conductor. The third component is a high frequency alternating current power source to produce in the central conductor sufficient current flow through the conductor at a sufficiently high frequency whereby the magnetic field produced around the central conductor causes the lossy ferrite-type body to heat by hysteresis losses to its Curie temperature. When the ferrite-type body reaches its Curie temperature, its magnetic permeability sharply decreases thereby decreasing the amount of the heat produced by the hysteresis losses in the ferrite-type body. The result is a heating device which self-regulates a the Curie temperature of the ferrite-type body. As will be apparent to one skilled in the art, the embodiments and configurations of the devices of this invention can vary over a wide range. In one preferred aspect, the ferrite-type body is electrically non-conductive, and in another preferred aspect, the power supply is a constant current power supply. Similarly, it will also be apparent that there will be a wide range of uses and applications for the various embodiments of the devices of this invention.

Numerous advantages are immediately realized from the simplicity and effectiveness of the device of the present invention. The ferrite-type body can be selected from conventional ferrite beads, blocks, rings, etc., which are commercially available. The only requirements in selecting an appropriate ferrite-type body for use in the present invention are that it have sufficient magnetic permeability for the coupling with the high frequency magnetic field, that it be highly lossy, i.e., sufficiently lossy to heat itself by hysteresis losses to a desired temperature, and that it have the desired Curie temperature to provide the temperature at which the device will be self-regulating.

The devices of this invention are particularly advantageous because they are capable of producing significantly higher watt-density in heaters than could be achieved with prior devices. Due to the high capacity of heat production in a ferrite-type body, such as a ferrite bead, and due to the fact that only a single conductor is needed in the devices of the present invention, a very small volume is needed for these devices. In contrast, the prior art devices, which required the presence of induction coils or other elements, resulted in increasing the size of the devices for a given amount of heat that could be produced. As used herein, the term "ferrite-type body" is intended to refer generically to any ferromagnetic or ferrimagnetic material, article or body which meets the necessary criteria of magnetic permeability, lossiness, and Curie temperature which enables the ferrite-type body to produce heat by hysteresis losses in the devices of the present invention. If electrically conductive ferromagnetic materials are used in the present invention, it may be necessary to provide certain electrical insulation between the central conductor and the ferromagnetic body and/or between the ferromagnetic body and any adjacent components. It is generally preferred, however, to use electrically non-conductive ferrimagnetic materials, in which case it is generally unnecessary to use electrical insulation between the central conductor and the ferrite-type body or the ferrite-type body and any adjacent members.

The central conductor used in the present invention can be a single wire positioned through the center of the ferrite-type body or can be a single conductor which makes multiple passes through multiple openings in the ferrite-type body. It will be recognized that a one or two wire central conductor will frequently be sufficient to provide the desired magnetic field for heating the ferrite-type body in accordance with the present invention. It will also be recognized that the central conductor can be any desired configuration, such as wire, tubing, and the like, and can be electrically insulated or uninsulated, depending on the electrical conductivity of the other components used in the heater device.

As also will be recognized, one of the numerous advantages of the present invention is that a single central conductor loop can be used where ferrite-type bodies, such as ferrite beads, can be placed at any desired spacing along the single conductor. When the single conductor loop is connected to and powered by the appropriate high frequency alternating power source, each ferrite-type body and each portion thereof positioned along the central conductor incrementally acts as an independent self-regulating heating device independent of the other ferrite-type bodies present along the central conductor. The optimum operation and self regulation of the system is achieved when the power source is a constant current power source. With sufficient power input, each ferrite-type body will heat to its Curie temperature and then self-regulate at its Curie temperature independent of each of the other ferrite-type bodies.

As can be seen, practically any configuration of self-regulating heating device can be devised using a ferrite-type body according to the present invention. These configurations range from a single heating element device such as a soldering tip, to complex heaters, such as a trace heater which may have different temperature requirements in different locations. Such a trace heater can be provided by a string of ferrite-type bodies each having the same or different Curie temperature properties but all being positioned on and operated by the single conductor loop powered by a single constant current power source. Thus, using the present invention the temperature at any particular location along a trace-type heating device can be precisely controlled to the desired temperature by selecting the ferrite-type body for use at that location to have that desired Curie temperature. The amount of heat that can be delivered to each incremental location along the trace-type heater will depend on the mass, surface area, shape and other characteristics of the particular ferrite-type body in a particular location and, of course, the use of a power source capable of delivering the desired power to each location as well as through the entire circuit. As will be recognized by those skilled in the art, the adaptability of the present invention to the design for particular uses in which precise temperature control is desired is quite high.

The devices of this invention have a wide variety of utilities. In addition to the soldering iron and strip heater embodiments illustrated herein, devices according to this invention can be a hot knife for various uses, cartridge heaters, hot melt adhesive applicators, as well as other uses that will be apparent to one skilled in the art following the disclosure herein. The heating devices of this invention can be sized and powered according to the use and service requirements. For example, a ferrite bead heater can be constructed for soldering iron tip use and, if powered by a 40 watt power source, can heat to Curie temperature in about 180 seconds. However, the same type heater can be constructed in the same size but for withstanding higher power loadings and, if powered by a 600 watt power source, can heat to Curie temperature in about 3 seconds. Thus, it can be seen that the desired use will dictate the power supply used and the device design. For some applications the 40 watt heater will be well suited, while for other applications, such as for robotic assembly line use, the 600 watt heater will be required for quick on/off operation. When the central conductor means used in the devices of this invention is a hollow tube, then a material such as a fluid can be passed through the hollow tube for heating. This tube may be wound in cylindrical fashion in order to package a long length of heater in a small space. A device of this type would resemble a heat exchange coil.

In another aspect, this invention is in part based on the fact that, contrary to prior practices of using an induction coil to heat ferrites, I have now determined that one can eliminate the use of an induction coil to produce the required magnetic field for induction heating with ferrites. This invention only requires that the correct combination of central conductor means, ferrite-type body and appropriate power source be used according to the disclosure herein. I have determined that using the correct combination thereof enables one to produce highly effective self-regulating heating devices utilizing a single central conductor with the ferrite-type body positioned around the central conductor connected to a high frequency alternating power source, preferably a constant current power source. In this combination and configuration, I have found that the magnetic field existing around the outside of a single conductor is sufficient to cause the ferrite-type body to heat by hysteresis losses to its Curie temperature and self-regulate at that temperature, when the appropriate power source is used. I have found it surprising that the circumferential magnetic field generated around a single conductor is of sufficient intensity for heating a ferrite-type bodies to their Curie temperature. I have found that this surprising result is in part due to the use of the appropriate power source having sufficiently high frequency to produce sufficient hysteresis losses in the ferrite body an thereby being capable of heating the ferrite-type body to its Curie temperature by passing high frequency current through the central conductor means.

It was previously perceived that in order to generate a useful amount of heat by inducing hysteresis loss heating in ferrite-type materials or bodies it was necessary to place the ferrite materials or bodies inside a multi-turn induction coil, i.e., into an intense magnetic field produced by the induction coil. The present invention produces surprising results by taking the opposite approach of putting a central conductor means in or through the inside of the ferrite body, thus producing the high frequency magnetic field from inside the ferrite-type body. Thus, using the circumferential high frequency magnetic field generated around the central conductor inside the ferrite-type body produces internal losses composed of eddy current or hysteresis losses which heat the ferrite-type body. Once the above principle of operation of this invention is understood and it is recognized that self-regulating heating devices can be easily constructed using the appropriate high frequency current from an appropriate power source, it will be recognized by those skilled in the art that many configurations of high watt-density heating devices can be produced with the combination of internal conductors in ferrite bodies to produce the desired magnetic field from the inside out. This can be done by passing the central conductor through the ferrite-type body only once, or twice, or any desired number of times. Multiple passes of the central conductor through a particular ferrite body may be unnecessary or undesirable where a single or double pass of a central conductor through the ferrite body will produce the desired impedance and heating as quickly and efficiently as multiple passes of the conductor through the ferrite body. In other words, there is no need to use more passes of the conductor through the ferrite body than will produce the desired load impedance to meet the power supply impedance. Multiple passes of the central conductor through, near or around the ferrite-type body can be used, however, to enhance the efficiency of the heating or to contribute to the impedance matching of the ferrite-type body heating element and the power supply.

Accordingly, this invention enables the construction of any length and configuration of series heater by placing ferrite bodies along the central conductor whether the central conductor makes a single pass or multiple passes through or around each ferrite body. When used with the appropriate high frequency power source, which is impedance matched and preferably constant current, each of the incremental ferrite bodies along the central conductor will function independently to produce heat and each will self-regulate at their own Curie temperature. It had been previously thought that the conductor supplying the current for producing the magnetic field must not be significantly heated, because its resistance would increase with increasing temperature, thus causing excessive resistance heating of the conductor as the hysteresis heating of the ferrite decreases with the decrease in permeability at increased temperature of the ferrite. While the conductor does exhibit increased resistance and can produce increased heating, it has been found not to be detrimental to the operation of the system of the present invention as long as the decrease in ferrite magnetic permeability and resultant decrease in hysteresis heating is greater than the increase in resistance and heating produced by the central conductor due to the heating of the conductor by the ferrite-type body.

All of the above advantages and capabilities of the present invention are particularly made possible without the necessity of having a separate device, such as an induction coil, for producing a magnetic field externally to heat the ferrite bodies. The internal utilization of the magnetic field from the inside out of the ferrite bodies is one of the distinctive features of the present invention. Since the ferrite-type body surrounds the conductor producing the magnetic field, 100% magnetic coupling of the magnetic field into the surrounding body can be assured.

As used herein, the term "ferrite-type body" includes both ferromagnetic materials and ferrimagnetic materials. It should be noted, however, that there has been some inconsistent usage of terminology with respect to ferrimagnetic materials and ferromagnetic materials. For example, compare the nomenclature used in White et al., U.S. Pat. No. 3,391,864 and in Lee, *Magnetism, an Introductory Survey,* Dover Publications, Inc., New York, 1970, FIG. 44, at page 203. The preferred nomenclature is believed to be that of Lee and is primarily used herein. See also Brailsford, *Magnetic Materials,* Methuen & Co. Ltd., London, 1960. It may be noted that the Néel temperature referred to by White et. al. for antiferromagnetic materials is, as a practical matter if not scientifically, considered the same as Curie temperature for ferromagnetic materials and ferrimagnetic materials in general.

The term "ferromagnetic" has frequently been used to refer to magnetic materials generically, regardless of their particular properties. Thus, ferrites have frequently been referred to as being "ferromagnetic" or included in the general group of "ferromagnetic" materials. However, for purposes of this invention, it is preferred to use the terminology shown in FIG. 44 of Lee, referred to above, wherein the magnetic materials are classified in two groups, ferromagnetic and ferrimagnetic. The ferromagnetic materials are usually considered to be electrically conductive materials which have various magnetic properties. The ferrimagnetic materials are usually considered to be electrically non-conductive materials which also have various magnetic properties. Ferrites are usually considered to be electrically non-conductive materials and are thus in the class of ferrimagnetic materials. Both ferromagnetic materials and ferrimagnetic materials can be low-loss, or non-lossy, type of materials, which means they do not have significant energy loss or heat produced when subjected to an electric potential or magnetic field. These non-lossy type of magnetic materials are the kind used in various electric equipment components, such as ferrite cores for transformers, where it is desired to contain and intensify a magnetic field, but where no or minimum energy loss/heat production is desired. However, both the ferromagnetic and ferrimagnetic materials can also be the high-loss, or lossy, type of materials, which means they will have significant energy loss, and heat production, such as by hysteresis losses, when subjected to an electric potential or magnetic field.

For use in the present invention, as indicated above, either electrically conductive ferromagnetic materials or electrically non-conductive ferrimagnetic materials may be used in the present invention and are referred to herein as the "ferrite-type body" component of the present invention. It is to be noted that the appropriate precautions are to be taken with the conductive ferromagnetic materials to appropriately insulate them in the devices designed in accordance with the present invention. It is because of this added consideration, the electrically non-conductive ferrimagnetic materials and particularly the ferrites are preferred for the present invention, since the central conductor which is subjected to temperatures of at least the Curie temperature of the ferrite need not be electrically insulated with insulation material which would be required to withstand such temperatures.

Whether the ferrite-type bodies selected for use in the present invention are ferromagnetic or ferrimagnetic, they must possess three properties which are essential for their operation in the present invention. First, they must have sufficient initial permeability to couple with the magnetic field produced by the central conductor. Secondly, they must be sufficiently lossy to produce the desired heating by hysteresis losses when subjected to the magnetic field produced by the central conductor. And third, they must have a Curie temperature in the range or at the temperature desired in order for the device according to the present invention to be self-regulating at the desired temperature in the desired application. As will be recognized from the description herein, the ferrite-type body can be made up of any ferromagnetic or ferrimagnetic bodies or materials desired, including powders held in the desired shape by any desired means.

As will be recognized by those skilled in the art, the high permeability, highly lossy ferrite-type materials useful in the present invention can be used in combination with high permeability, low-loss or non-lossy ferromagnetic or ferrimagnetic materials which may enhance or aid in maintaining the coupling of the magnetic field through the highly lossy ferrite-type body, enhance impedance matching or for other purposes. This practice is similar to that disclosed in my co-pending application Ser. No. 07/465,933 filed Jan. 16, 1990, incorporated herein by reference. This technique can be used to enhance the performance of the highly lossy heating ferrite-type body in the present invention. However, a trade-off may be encountered in terms of watt density if the non-lossy ferrite-type material adds to the volume of the heating element but does not contribute to heat production. Thus, the use of combinations of lossy and non-lossy ferrite-type material in the present invention is an option which can be selected by one skilled in the art according to the present disclosure.

As will be apparent to one skilled in the art, various ferrite-type bodies can be made from various materials for use in this invention when they have the properties and meet the criteria set forth above. For example, a nickel-iron powder can be combined in a mixture with an insulating binder, such as boron nitride, shaped into the desired form and the binder cured. This can produce ferrite-type bodies which are electrically non-conductive and have relatively high Curie temperatures, such as 350° C., which make them useful for devices such as soldering irons.

Conventionally available ferrite beads and bodies of various shapes are particularly well suited for use in self-regulating soldering irons and other heating devices according to the present invention. As is well known, ferrite beads can possess any particular Curie temperature desired within a quite broad range by compounding them with oxides of zinc, manganese, cobalt, nickel, lithium, iron, or copper, as disclosed in two publications: "The Characteristics of Ferrite Cores with Low Curie Temperature and Their Application" by Murkami, *IEEE Transactions on Magnetics*, June 1965, page 96, etc., and *Ferrites* by Smit and Wijn, John Wiley & Son, 1959, page 156, etc. For purposes of the present invention, any ferrite material which is highly lossy in an alternating magnetic field of about 10 MHz or above is preferred and considered most suitable. A ferrite material is considered highly lossy when it produces sufficient heat by hysteresis losses to heat itself to its Curie temperature in the available magnetic field. This also requires the material to have sufficient magnetic permeability to couple with the available magnetic field and to have a Curie temperature at a useful and desired level. Additionally, a ferrite material can be readily selected which has a Curie temperature appropriate for a heating device of this invention. For example, if the device is a soldering iron, the Curie temperature should be slightly higher than the melting point of the particular solder material which is to be heated and reflowed. If the device is a trace heater to prevent ice formation, a Curie temperature slightly higher than 0° C. may be appropriate.

It is preferred to use ferrite-type bodies which have high impedance. This enables impedance matching the ferrite-type body with a high impedance power supply for minimum size and maximum efficiency. One may observe that some commercially available ferrite beads may change in impedance characteristics after they are first used in the device of the present invention. Therefore, in some instances it may be necessary to verify the desired impedance of the devices of this invention after their initial use.

The commercially available ferrite beads, blocks, rings and other shapes used for filters, noise suppressors, shielding, etc. are particularly well adapted for use as the heating elements in the present invention because of their availability and temperature stability. Such various shapes of ferrite bodies are commercially available from suppliers such as Ferronics Incorporated of Fairport, N.Y. and Fair-Rite Products Corp. of Wallkill, N.Y. 12589, who also publish the electrical and magnetic properties of the various ferrite bodies, including permeability, loss factor, Curie temperature, etc. Typically, ferrite beads are made by pressing ferrite powders into the desired shape and then baking or sintering the resulting shape at very high temperatures to provide the ferrite body having the desired properties of Curie temperature, magnetic permeability, etc. Since these ferrite bodies have already been sintered at very high temperatures, which are typically well above the Curie temperature of the ferrite body, use of these ferrite bodies in the present invention to repeatedly cycle to their Curie temperature, as a result of being heated internally by hysteresis losses, provides a device which has good stability.

The performance of such ferrite beads in the present device will not significantly deteriorate under normal operating conditions. It may be noted that extreme thermal shock can cause a ferrite bead in the device of this invention to break or crack. However, such breaking or cracking will not normally affect the effectiveness of the device of this invention provided that the physical integrity and positioning of the entire ferrite bead mass in the magnetic field around the central conductor of the present invention is maintained.

The power supply useful in the present invention is an alternating current, high frequency power supply which is capable of producing a magnetic field of sufficient strength around the central conductor which will couple with the high magnetic permeability of the ferrite-type body positioned around the central conductor. The power supply must be of a sufficiently high frequency and power level to enable the ferrite-type body to heat by internal losses to its Curie temperature. For most ferrimagnetic materials significant hysteresis loss heating requires a frequency of at least about 10 MHz and preferably about 13 MHz or higher. For some ferromagnetic materials significant eddy current loss heating can be produced at frequencies below 10 MHz.

It is also preferred for the present invention that the power supply be a constant current power supply, such as those disclosed in U.S. Pat. Nos. 4,256,945, 4,877,944 and 9,414,267 referred to previously herein. A particularly useful and preferred power supply, commercially available from Metcal, Inc., Menlo Park, Calif. 94025, is a constant current power supply operating at a frequency of 13.56 MHz. While it is possible to use other types of high frequency alternating current power supplies with in the devices of the present invention, it has been found that the constant current power supply with the appropriate impedance matching provides the best and most efficient method for which the devices of the present invention can be self-regulating within the desired tolerances.

In general, as noted above, lossy ferrimagnetic materials, such as ferrite beads, are usually electrically non-conductive and produce heat by hysteresis losses when subjected to an appropriate alternating magnetic field. In a preferred embodiment, the present invention makes use of ferrimagnetic materials, such as ferrites in various shapes, to construct a high impedance soldering iron tip having a very high watt-density and which is self-regulating.

Various embodiments of the present invention are illustrated in the drawings referred to below.

FIG. 1 illustrates a soldering iron tip 10 constructed in accordance with the principles of the present invention. Soldering iron tip 10 includes a connector 12 adapted for connection to a high frequency, preferably constant current power supply (not shown). This soldering iron tip can be constructed to be used conveniently in a cartridge, for example, as shown in U.S. Pat. No. 4,839,501. The frequency range of the power supply required for best operation of the self-regulating soldering iron is any frequency greater than about 10 MHz. A preferred frequency is 13.56 MHz produced by a commercially available constant current power source, a RFG 30 available from Metcal, Inc., Menlo Park, Calif. 94025. A bare copper wire 14 connects to connector 12 and passes through ferrite bead 16. The ferrite bead 16, with the wire 14 therethrough, is adapted to be press-fitted into a metallic cap 18. This connection is shown more clearly in FIG. 2, which illustrates a cross-sectional view of the assembled tip with the ferrite bead 16 and wire 14 inserted into the cap 18. Cap 18 includes a recess 20 into which the wire 14 is inserted, where it extends out from the bead 16.

Central conductor 14 can be constructed from any conductive material, preferably copper. In this embodiment, the wire has a diameter of 0.050 inches. The cap 18 is formed from any thermally conductive material. In this embodiment, the cap 18 is formed of copper because of its good thermal conductivity and because it is a conventional material used in soldering iron tips and is easily iron plated for proper wetting by molten solder.

In the embodiment shown in FIG. 1, the ferrite bead 16 is a Fair-Rite Part No. 286100182, Fair-Rite Products Corp., Wallkill, N.Y. This bead is 0.25 inches in the diameter, 0.25 inches long with two 0.050 inch holes therein with 0.1 inch between them and has a Curie temperature of 350° C. The initial impedance was 12 ohms at 0°, when series resonated. The impedance was matched using a series and parallel capacitor matching network. The matched assembly drew 40 watts from the RFG 30 and self-regulated at 350° C. This assembly was alternatively connected to a RFX-600 power supply, available from Advanced Energy Corp., Fort Collins, Colo. The power supply was adjusted to deliver 350 watts to the load submerged in water so as to provide a means of thermally loading the tip for testing purposes. While still under power, the tip was withdrawn. The tip immediately self-regulated down to approximately 50 watts. This test was repeated several times, each time with the same result. The tip also was used to successfully melt solder. The solder used in the test was SN 63. Other shapes of ferrite beads that may be used can be selected from those in a Fair-Rite Bead, Balum and Broad Band kit available from Fair-Rite Products Corp., Wallkill, New York, depending on the shape and size of heating device desired. Ferrite beads having Curie temperature sufficiently high for soldering use and having high impedance for high power output uses are also available from Ferronics Incorporated of Fairport, N.Y., particularly their "K" type ferrites, such as Ferronics parts no. 21-031-K which has a Curie temperature of about 350°C.

As noted above, the ferrite bead selected for use in this embodiment is highly lossy when operated at frequencies greater than about 10 MHz and will heat to its Curie temperature in the circuit illustrated.

As will be recognized by one skilled in the art, it may be necessary to connect central conductor wire 14 to an impedance matching circuit to create a matched impedance between the power supply and the ferrite bead/-wire circuit. Whether such an impedance matching circuit is required depends on the particular configuration and properties of the ferrite beads(s), conductor and power supply employed in a particular embodiment of the invention. For example, the circuit may be impedance matched by placing a single capacitor of appropriate capacitance value in series or in parallel with the central conductor wire 14.

Figure 2:
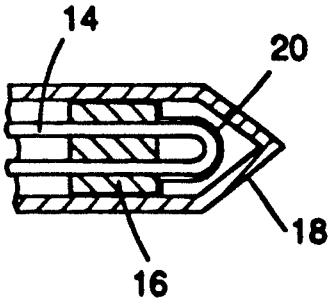
FIG. 2 illustrates a cross-sectional view of the tip of FIG. 1, in its assembled form, taken along the line II—II.
Figure 16:
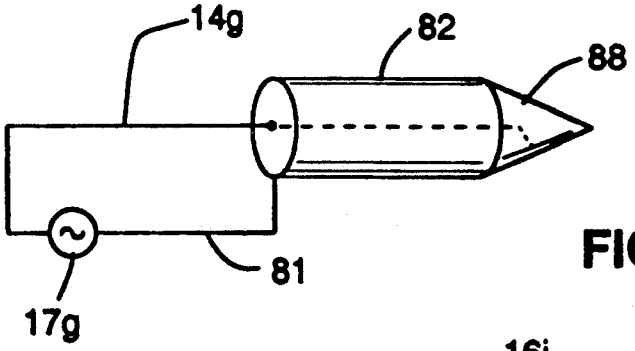

As can also be noted in FIG. 2, central conductor wire 14 is placed in electrical contact with the cap 18 when the ferrite body 16 is inserted into the cap 18. This cap 18 may be maintained at ground potential, such as illustrated in FIG. 16, when the soldering iron is operating. Although this is not necessary for operation, it is desirable so that no damage is done to sensitive electronic circuits.

Figure 3:
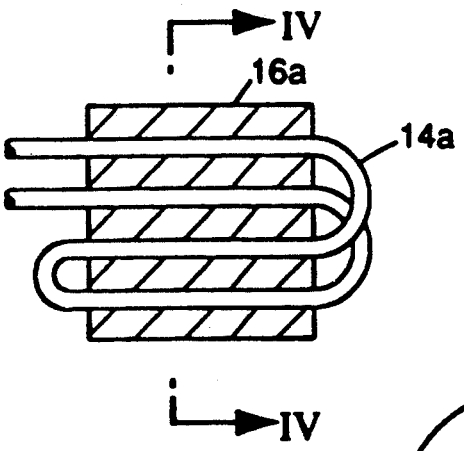
FIG. 3 illustrates a cross-sectional view of a preferred embodiment of a ferrite bead heater element according to the present invention wherein the wire is doubled through the ferrite bead.
Figure 4A:
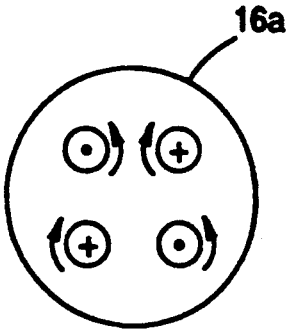
FIGS. 4A and 4B illustrate, in cross section view along lines IV—IV of the bead heater of FIG. 3, the difference in the magnetic fields created by positioning the magnetic wire in the ferrite bead in particular ways.
Figure 4B:
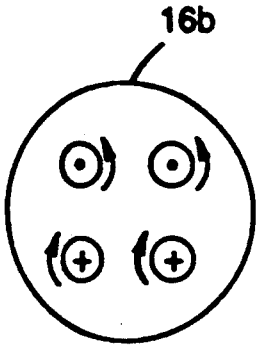

FIG. 3 illustrates another configuration of the central conductor and the ferrite body for use in the present invention, which can also provide a larger impedance value. As shown in FIG. 3, double central conductor wire **14*a* is passed twice through the ferrite body 16*a*. The ferrite body will have a given impedance value depending upon the intensity of the magnetic field that is produced around the conductor. As shown in FIG. 4, passing wire 14*a* through the ferrite body in a particular manner will yield a particular impedance value based on the respective directions of the magnetic fields produced. In FIG. 4A and 4B, a "+" sign indicates a current directed into the page producing a clockwise magnetic field and a "." indicates a current directed outwardly of the page and a counter-clockwise magnetic field, according to standard right-hand rule notation. By placing the wire as shown in FIG. 4B, the magnetic fields oppose each other differently than in FIG. 4A, and will serve to increase the apparent impedance of the ferrite body. This can also be useful in matching the impedance of the power supply and the remainder of the circuit. As disclosed elsewhere herein, if central conductor 14*a*** is a hollow copper tube instead of a wire, the device can be used to heat a fluid passing through the copper tube.

Figure 5A:
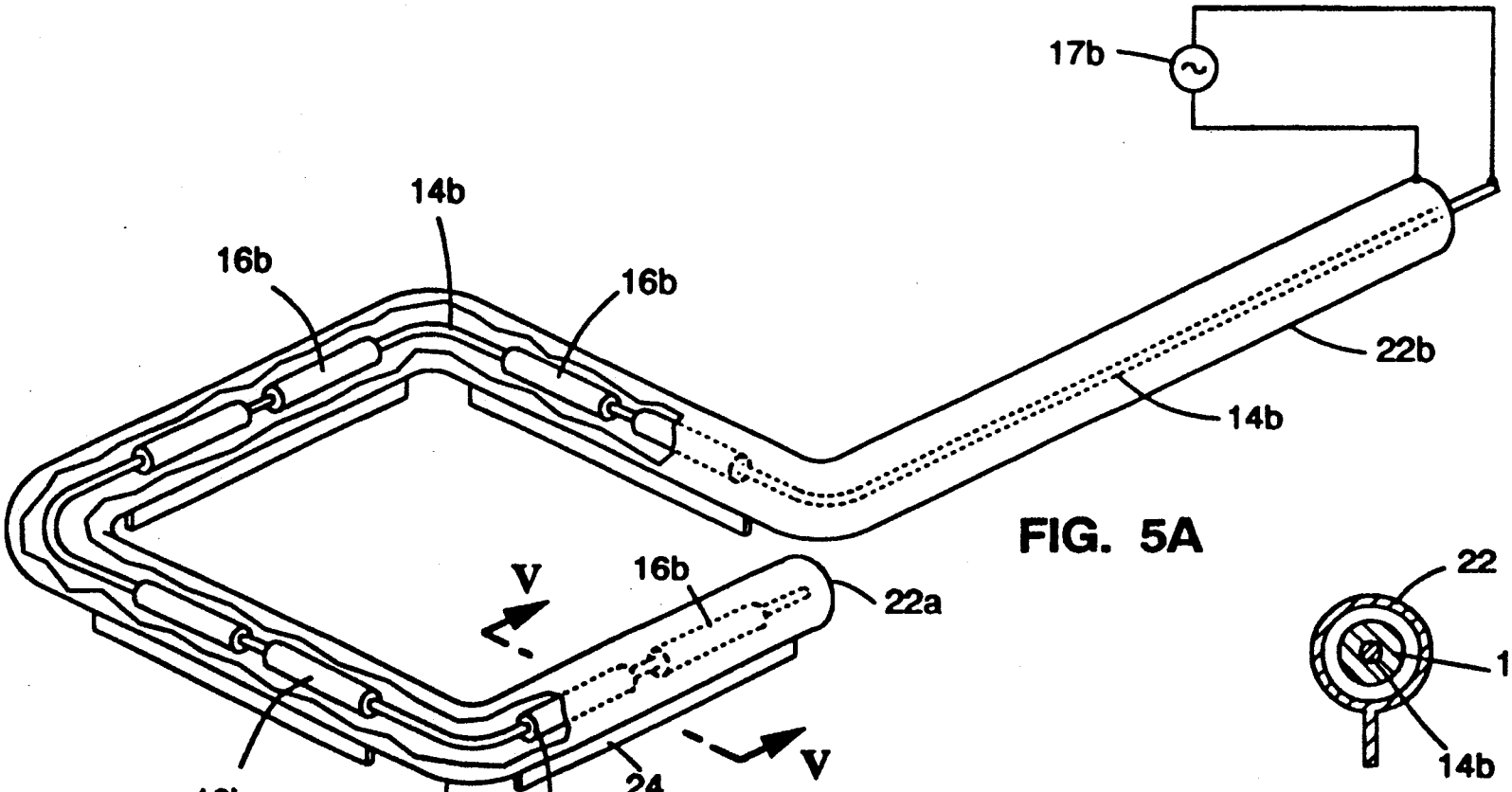
FIG. 5A illustrates a perspective view of another embodiment of the present invention in the form of a chip carrier surface mount soldering iron.
Figure 5B:
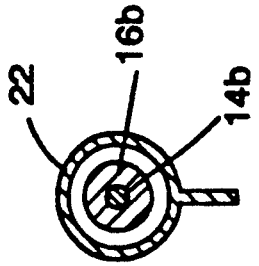
FIG. 5B illustrates a cross-sectional view of the surface mount soldering iron of FIG. 5A taken along the lines V—V.

FIG. 5A illustrates another embodiment of the present invention, and FIG. 5B illustrates a cross-sectional view of a part of the embodiment of FIG. 5A. This embodiment is in the form of a square integrated circuit chip carrier soldering device 22. As can be seen in partial cut-away perspective view FIG. 5A and cross-section view FIG. 5B, the device is constructed of tubular member 22 having fins 24 extending therefrom. Although this embodiment is shown as a square device sized, shaped and adapted for soldering or desoldering chip carriers, surface mount devices, etc., it is clear that the tubular member may be shaped as desired to fit a particular desired heating application and that the tubular members can be any other type of member, such as open channel, flat strip, square tube, etc., that is appropriate to the heating application in question. A closed construction, however, yields a shielded device, i.e., one which produces no radiated electromagnetic fields. Fins 24 extend on the underside of the device 22 and heat by conduction during operation of the device and are adapted to be brought into contact with the solder material to be melted or with the contacts to be soldered or desoldered. Central conductor wire **14*b*, preferably copper, passes through a plurality of ferrite beads 16*b*. This type of device is easily constructed by taking a single conductor wire and ferrite beads having a hole in each, which are slipped onto the wire and spaced along the conductor wires at desired intervals and held in place by adhesive means, crimps in the conductor wire or other means. This string of ferrite beads is then inserted into tube 22, which is metallic, such as copper. The tube containing the string of ferrite beads on conductor 14***b* can then be shaped to any desired shape and dimension to provide a heating device according to the present invention. The resulting device will be entirely or locally self-regulating at the Curie temperature of the ferrite beads. The end of conductor wire 14*b* is electrically connected to the end of the tube 22 at end 22*a*, such as by crimping the end of tube 22 closed with wire 14*b* crimped therein to make electrical connection. The other end 22*b* of tube 22 forms a handle for moving and using the device. Conductor wire 14*b* is connected to and powered by power source 17*b* as shown. In the embodiment shown in FIG. 5, eight ferrite beads are used, but this number can be varied depending upon the size and impedance of the device, the size and Curie temperature of the ferrite beads and the heat distribution desired. As is readily apparent this type of device is useful as a hand held tool or can easily be adapted to automated machine use. Care should be taken to insure a tight fit of the beads within the tube in order to minimize thermal resistance thus maximizing heat transfer and thermal response.

Figure 7:
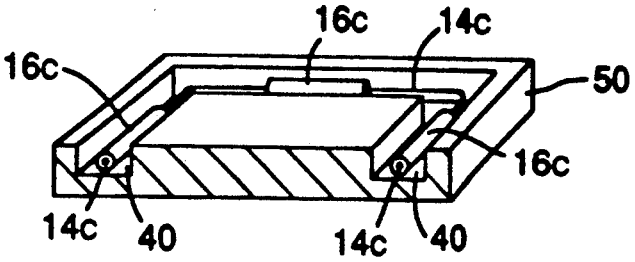
FIG. 7 illustrates a cross-sectional view of the surface mount soldering iron tip shown in FIG. 6 taken along the line VII—VII.
Figure 6:
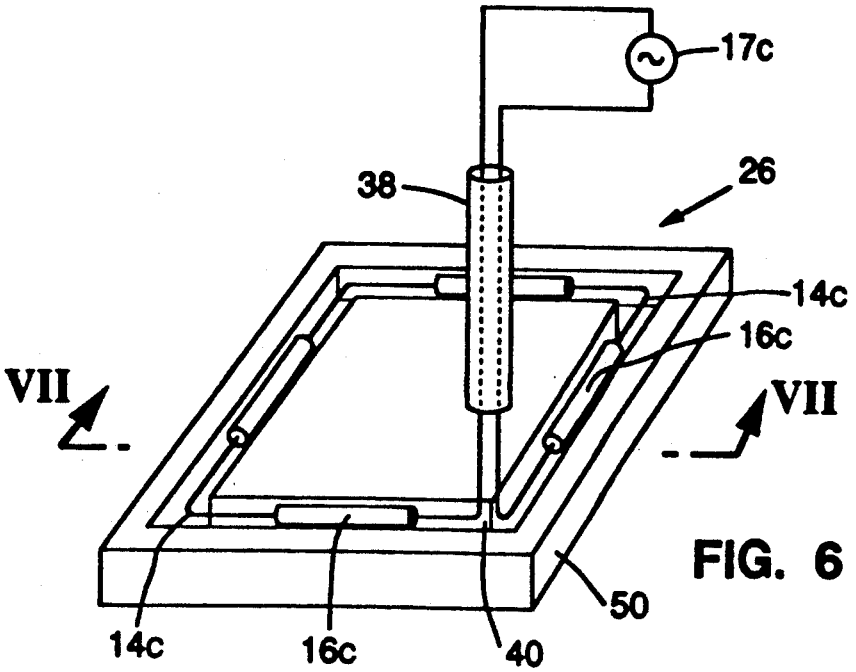
FIG. 6 illustrates a top view of a surface mount soldering iron tip according to another embodiment of the present invention.

Another embodiment of the present invention is shown in partial plan view in FIG. 6 and in cross-section in FIG. 7 in which the heating device 26 is a soldering iron for surface mount use. It comprises a square base 50 with channel 40 for receiving a string of four ferrite beads 16*c* on central conductor 14*c*, a copper wire. In this device, heat is generated by the ferrite beads at the four side edges of the base 50 and not in the center portion of the surface mount device 26. In the embodiment shown in FIG. 6, the ends of the conductor 14*c* are positioned from edge area the non-heated central portion of the base 50, through vertical handle 38 to power supply 39.

The embodiment shown in FIG. 6 ia a surface mount solder device, 1.25"×1.25", constructed using four ferrite beads. Each bead was Fair-Rite Part No. 2664225111. The beads were placed on a 0.045 inch diameter piece of copper wire and potted in a thermally conductive epoxy (Thermalbond 4951, available from Thermalloy, Inc., Dallas, Tex.) to a plate of copper adapted to fit around a surface mount integrated circuit package. The impedance was 125 ohms at 0° phase without matching capacitors. The device pulled 40 watts from a RFG 30 power supply and the beads self-regulated at their Curie temperature almost immediately. Infrared gun temperature readings indicated that the beads were at 160° C. and the outer perimeter of the surface mount plate was at 130° C. By loading the plate with a wet sponge, on each of its four sides, self-regulation at each side was verified. Since 130° C. is not hot enough to melt SN 63 solder, beads having a higher Curie temperature, above SN 63 melting point, may be used. For example, by using ferrite beads having a Curie temperature of at least 213° C., and allowing for the 30° C. temperature drop, the melting point of SN 63 solder can be accommodated.

Figure 8:
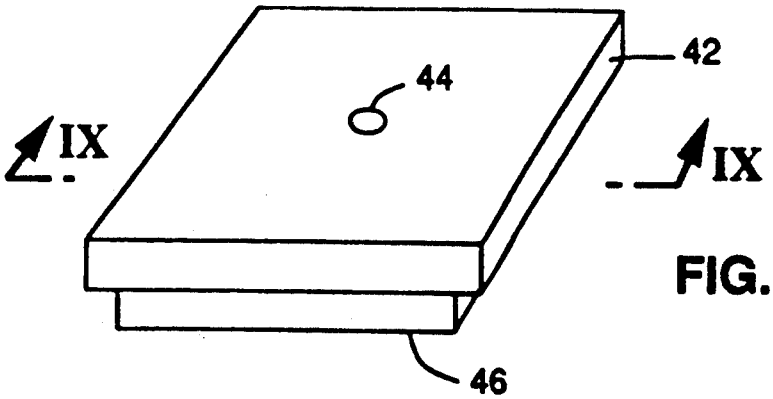
FIG. 8 illustrates a perspective view of a cap adapted to fit on the surface mount tip shown in FIG. 6.
Figure 9:
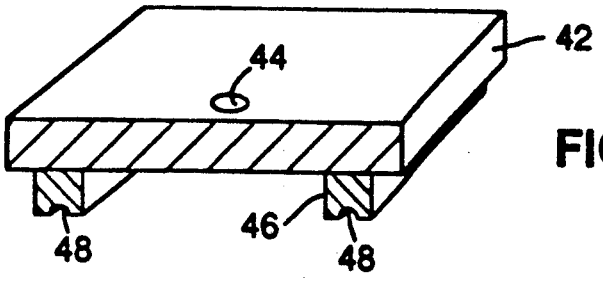
FIG. 9 illustrates a cross-sectional view along lines IX—IX of the cap of FIG. 8.

FIG. 8 illustrates a perspective view of a cap 42 adapted to fit on the surface mount soldering iron of FIG. 6. Cap 42 includes hole 44 which receives handle 38. A rim 46 extends downwardly of cap 42 and fits into groove 40. Cross-section view of FIG. 9 shows that rim 46 includes groove 48 into which the ferrite beads 16*c* fit when the cap 42 is fitted on the base 50. In this way, the ferrite beads 16*c* are secured in proper position. Optionally, cap 42 or at least rim 46 can be of a material of high thermal conductivity so the heat produced by the ferrite beads is directed into base 50 to enhance the soldering capability of device 26.

Figure 10:
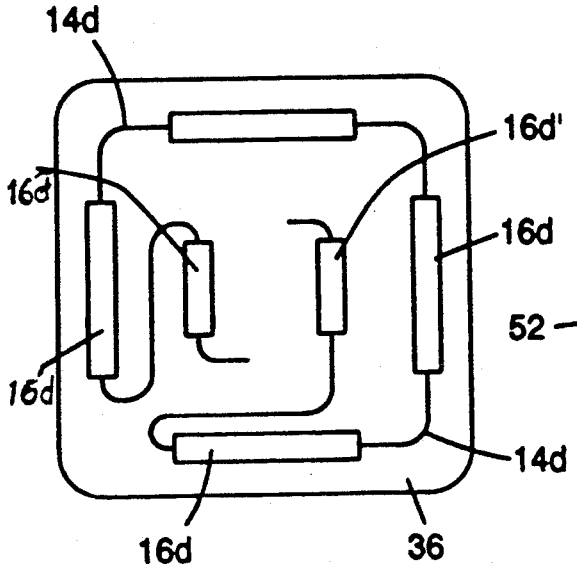
FIG. 10 illustrates a top view of a soldering iron tip according to another embodiment of the present invention.
Figure 11:
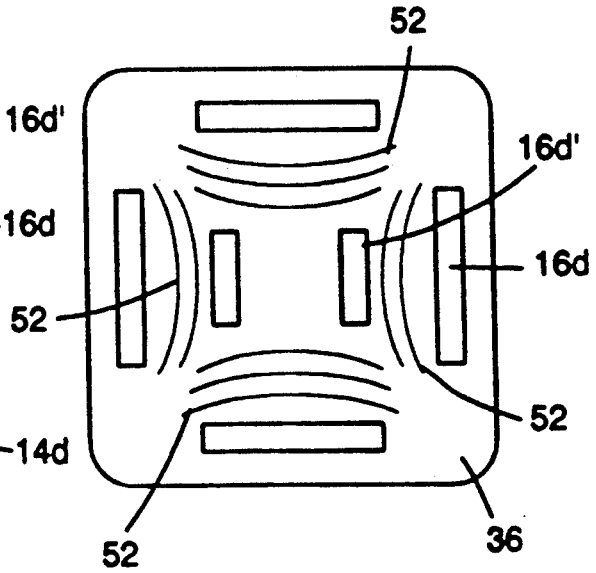
FIG. 11 illustrates an embodiment for impedance matching design of the soldering iron tip shown in FIG. 10.

FIG. 10 illustrates another surface mount device embodiment of the present invention in which conductor 14*d* passes through six ferrite beads 16*d*, 16*d*'. Four the beads 16*d* are positioned on the periphery of the base 36 and secured thereto by any desired means, such as mechanical clips or by high temperature adhesive. Two of the ferrite beads 16*d*' are placed at the isothermal line locations 52, shown in FIG. 11, and function as impedance matching beads. The location of the impedance matching beads, along the isothermal lines 52 allows beads 16*d*' allow the device to achieve the desired impedance without interfering with the thermal properties of the surface mount device. The impedance matching beads 16*d*' are selected to have a Curie temperature similar to the operating temperature along isothermal lines 52 so that they do not generate excess heat in the central portion of the surface mount device, but can help maintain the desired self-regulated temperature gradient throughout the device 36. The impedance of the surface mount device 36, of course, depends on the number of ferrite beads, the size, aspect ratio, density and other properties of the beads.

It is generally preferred that the aspect ratio of the outside diameter to the inside diameter be low in order to prevent the inner part of the bead from heating too rapidly compared to the outside of the bead, which can induce thermal stresses in the beads and lead to structural cracking. Also, the lower aspect ratio provides for a uniform temperature throughout the wall thickness of the bead, improving thermal response.

Figure 12:
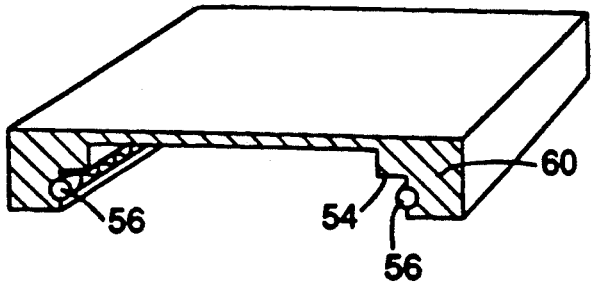
FIGS. 12 and 13 illustrate a surface mount soldering iron tip having a solder wick member according to an embodiment of the present invention.
Figure 13:
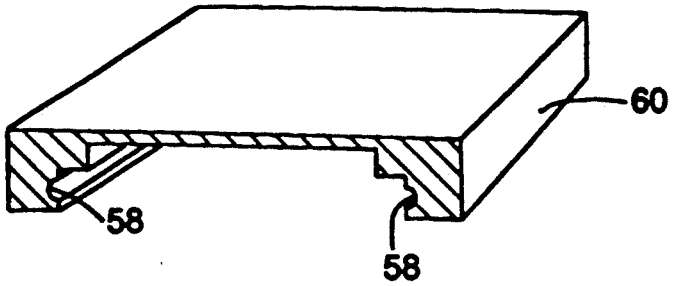

FIGS. 12 and 13 illustrate in cross-section a feature which can be implemented in any of the above surface mount soldering devices. In particular, an indentation 54 can be formed in the underside of the plate 60 for mating with and contact of the edge of the chip carrier and the contacts along the edge of the chip carrier. In FIG. 12, a small piece of "Solder Wick", that is, a piece of fine braided copper wire in the form of metallic tubular braided member 56, can be inserted or spot-welded to the inside surface of indentation 54. In FIG. 13, the solder wick (not shown) can be spot-welded into groove 58. The solder wick of FIGS. 12 and 13 provides a means of holding molten solder and making a compliant contact of the heated surface and the contacts and/or chip carrier to improve the soldering operation. As can be seen, affixing plate 60 to the device of FIG. 10 provides self-regulated heating at the perimeter edges of plate 60 where the solder wicks are located. An integrated construction may also be used.

Figure 14:
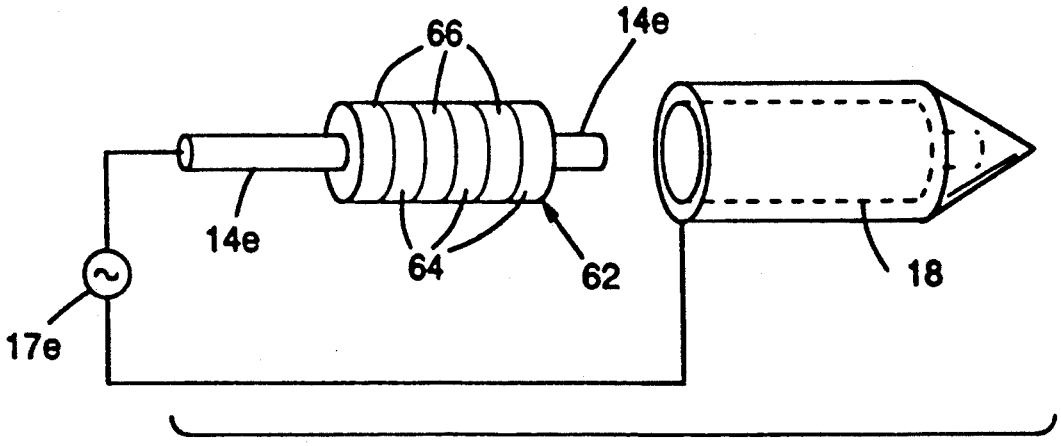
FIGS. 14, 15 and 16 illustrate soldering iron tips according to additional embodiments of the present invention.

FIG. 14 illustrates another embodiment of the present invention wherein self-regulating heating element 62 comprises an assembly of alternating ferrite disks 64 and copper disks 66 which are assembled in the configuration shown and surround central conductor 14*e*. This assembly is then placed in metallic housing 18 with the end 14*e*' of conductor 14*e* making electrical contact with the metallic cover or housing 18. Copper disks 66 are electrically isolated from conductor 14*e*. This may be accomplished by making the inside diameter of the copper disks 66 slightly larger than the diameter of conductor 14*e*. This assembly then forms a self-regulating soldering iron which is adapted to be powered by high frequency alternating power source 17*e* which is connected to central conductor 14*e* and the metallic housing 18. This embodiment illustrates the fact that the ferrite body heating element for use in the self-regulating heating devices of the present invention can be of any desired shape or design. In this particular embodiment the ferrite disks 64 are selected according to their magnetic properties and Curie temperature in order to provide their desired heating properties in the overall device. Copper disks 66 are used to enhance the heat transfer from the internal part of heating element 62 to the metallic cover 18 to provide a heating device of increased efficiency and response.

Figure 15:
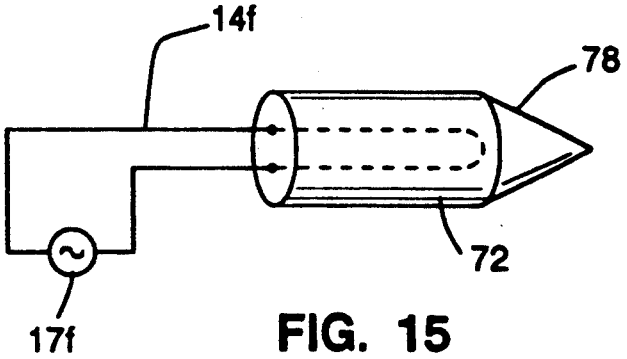

FIGS. 15 and 16 illustrate yet other embodiments of the present invention also in the form of a soldering iron device wherein ferrite bodies 72 and 82 are assembled with central conductors 14*f* and 14*g* which in turn are connected to power sources 17*f* and 17*g*, respectively. In these embodiments the surface of the ferrite bodies 72 and 82 are metalized with a metallic coating 78 and 88 which provides the metallic exterior of the soldering iron device. In these configurations, the heat transfer from ferrite bodies 72 and 82 to the surface metal 78 and 88 is highly efficient where the metalized surface is formed on the surface of the ferrite body as an integral unit. The ferrite bead metalized outer surface made by spraying with molten metal, vapor deposition, plating, or other known means enables the ferrite bead itself to be used as the soldering iron tip. Metalizing the ferrite beads in this manner may also be used to reduce the thermal resistance of the bead if it is press fitted into an assembly, the metalizing will act as a ductile high thermal conductivity interface. The present invention is described and exemplified by the above embodiments particularly with respect to self-regulating soldering devices. However, it is to be understood and it will be recognized by one skilled in the art that the ferrite-type body heaters of the present invention can also be embodied in a variety of other self-regulating heater configurations and applications. For example, the present invention can be adapted to heaters used to cure adhesives in or on a bond line. A conductive wire is passed through a number of ferrite beads, and this string of ferrite beads on the wire is then placed on or in an adhesive which is placed on the desired bond line. The wire is then powered as disclosed herein in order to heat the beads to a sufficient temperature to cure the adhesive. The present invention can also be adapted to desoldering tools wherein the central conductor passing through the ferrite bead is hollow, such as a small copper tube. A vacuum is applied to the back end of the hollow conductor to suck molten solder out and away from the tip as the solder melts. Additionally, the present invention can be adapted to form incrementally self-regulating blanket heaters which are used in various chemical processes and for other uses.

Another application of the present invention is as heat tracing devices which can be used for preventing pipes from freezing in cold temperatures. In such heat tracing device embodiments, a central conductor, such as a conductive wire, which is threaded through a number of ferrite beads can be placed along or around the pipes and powered as disclosed herein to heat ferrite beads to their Curie temperature. For example, a freeze protection heater can be made using ferrite beads which have a Curie temperature between 0° C. and 5° C. by placing a string of such ferrite beads on a conductor to form an elongate heater that can be placed along or around a pipe. The conductor is connected to the appropriate high frequency current power source as disclosed herein. As long as the ambient temperature is above about 5° C., the magnetic permeability of the ferrite beads remains low and no heat is produced by the ferrite beads. When the ambient temperature drops below 0° C., the magnetic permeability of the ferrite beads increases thereby causing the current in the conductor to heat the beads. The ferrite beads will self-regulate at their Curie temperature and prevent the temperature of the pipe or other member from falling below 0° C. when the ambient temperature falls below 0° C.

Figure 18A:
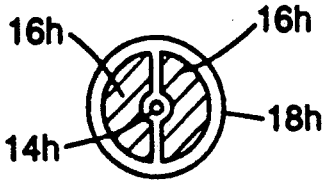
FIGS. 18A and 18B illustrate in cross section view additional embodiments of the heater element of the present invention.

As will be recognized by one skilled in the art, the ferrite-type body used in the present invention need not be a single body as illustrated in the above figures. The ferrite body can actually be comprised of several pieces or components positioned around the central conductor. For example, as shown in FIG. 18*a*, the ferrite body comprises two half shells, 16*h*, which are positioned around central conductor 14*h*. Preferably, the heater will have a metal or other surface 18*h* suitable for conducting or transmitting the heat produced by ferrite bodies 16*h* from the heater to the substrate material which is being heated. Heat transfer surface 18*h* can be the surface of the ferrite body 16*h* itself or can be a separate member or element which is efficient in heat transfer. Thus, one skilled in the art will appreciate that the ferrite body position around central conductor 14*h* can comprise any number of pieces and shapes in any desired configuration so long as the pieces of the ferrite body are appropriately positioned in the magnetic field of central conductor 14*h* to couple with the magnetic field, provide the desired impedance and produce the desired hysteresis losses in the pieces or components of the ferrite body to heat the ferrite body as a whole to its Curie temperature. As also can be seen this enables one to construct a heater according to this invention which can be used to provide a higher temperature on one side of the heater and a lower temperature on the other side. For example, if the two pieces 16*h* of the ferrite body in FIG. 18*a* have different Curie temperatures, then the two sides of the heater configuration in FIG. 18*a* will self-regulate at their respective Curie temperatures, one half higher than the other half.

Figure 18B:
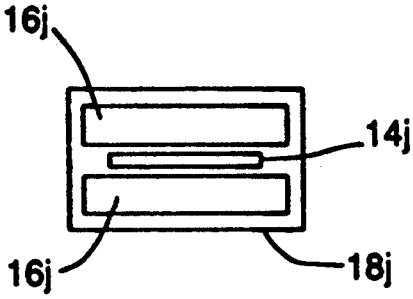

FIG. 18*b* illustrates yet another embodiment of the self-regulating heaters of the present invention illustrating that central conductor 14*j* can be a flat electrical conductor or any other desired configuration and does not necessarily need to be a conventional round wire. For example, in this embodiment 14*j* can be a copper ribbon and the ferrite body is comprised of two flat sheets of ferrite material 16*j* which are positioned on each side of conductor 14*j* in order to couple with the magnetic field produced around conductor 14*j*. Preferably the heater will have cover or case 18*j* which is suitable for clamping and retaining the ferrite bodies 16*j* and to facilitate heat transfer along the substrate or material to be heated by the heater of this configuration. Alternatively, the ferrite bodies 16*j* themselves may have an appropriate surface for transferring heat to the substrate or material being heated. As will be appreciated in this embodiment, when the constant current power source applies the appropriate high frequency current to conductor 14*j* heat is produced in ferrite bodies 16*j* by hysteresis losses. The magnetic field around and produced by 14*j* heats ferrite bodies 16*j* to their Curie temperature at which temperature the ferrite bodies self-regulate. As will be apparent, the ferrite body in FIG. 18*b* can be a single rectangular ferrite body closed on the sides with a rectangular opening in the center for receiving a flat copper ribbon central conductor.

It will also be appreciated from the embodiments illustrated in FIGS. 18*a* and 18*b* that the ferrite body can crack or break from thermal stresses or other causes and so long as the pieces of the ferrite bodies are held in proper position, for example, by covers 18*h* or 18*j* the heater device according to the present invention will continue to function essentially as it originally functioned before the ferrite body cracks or breaks. It is essential that in all embodiments of this invention that the ferrite-type bodies not be subjected to high mechanical stresses either upon assembly or upon heating. If the ferrite-type bodies are subjected to high stress this will cause a decrease in permeability and thus a decrease in heater performance. It will also be appreciated by one skilled in the art that the central conductor for producing the magnetic field to heat the ferrite body need not necessarily be in the center of the heater device. For example, in FIGS. 18*a* and 18*b* a heater device can be constructed according to the present invention using only one of the ferrite bodies illustrated in each FIG. 18 whereby the central conductor would be placed on the surface of or adjacent to the ferrite body. So long as the proper conditions are met according to the present invention, specifically where the ferrite body appropriately magnetically couples with the magnetic field of the conductor, the impedance matching is satisfactory, and the frequency and current of the power supply to the conductor is appropriate for heating the ferrite body to its Curie temperature, then the heater according to this invention will be self-regulating even though the conductor is not in the center or central portion of the heater device. Additionally heating only one side or portion of a device may be desired. One method of achieving this would be to construct the halves of device 18; from two different materials. The heat generating side can be constructed from lossy material while the non-heat generating side can be constructed from high permeability non-lossy material, the high permeability side acting to maintain magnetic coupling.

Figure 17A:
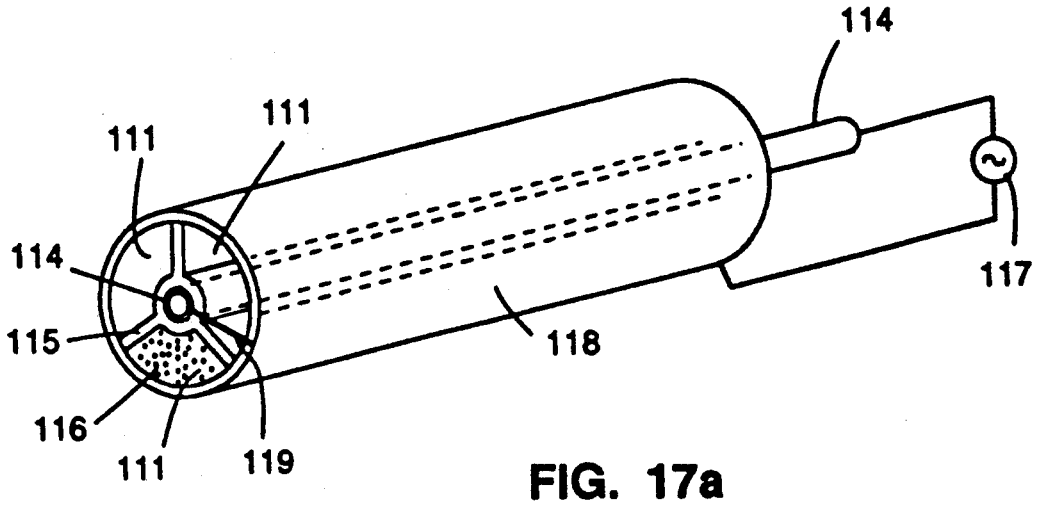
FIGS. 17A and 17B illustrate in perspective view elongate ferrite heater embodiments according to the present invention.

In other embodiments of the present invention, it will be apparent that the ferrite-type body useful in the devices of the present invention need not be the conventional ferrite bead type of body which is a hard, rigid, sintered type of body. The ferrite-type body useful in the present invention can comprise ferrite powder which has the desired Curie temperature and magnetic permeability properties. The powder can be shaped into the desired shape around a central conductor to form the self-regulating heater according to the present invention. A device according to this embodiment of the present invention is illustrated in FIG. 17*a*. In this embodiment a conventional air dielectric coax cable is used, which comprises a copper center conductor 114 held in the center of the coax cable by plastic spacer 115 positioned inside the cable having a copper outer conductor or shield 118, which is a conventional copper tube. The conventional coax cable of this type contains void spaces 111 between the plastic spacer which are normally filled with air. To convert the conventional coax cable to the self-regulating heater according to the present invention, a desired length of the cable is provided, center conductor 114 is electrically connected at one end of the length to the outer copper shield tube 118 by connector means 119. At the other end of the length of cable center conductor 114 and outer copper shield tube 118 are connected to the appropriate power source 117 as disclosed herein. Void spaces 111 are filled with a selected ferrite powder having the desired Curie temperature for the heater and the ends of the cable closed or sealed to hold the ferrite powder in place in spaces 111. An example of this embodiment of the invention was constructed using a 12-inch piece of air dielectric SA 50250 coax cable available from Precision Tube company. The coax cable has an O.D. of 0.375 in., a copper center conductor of O.D. 0.125 in. The ferrite powder was TT1-1500 available from Trans Tech, Inc. of Adamstown, Mass. When powered with an RFX-600 power supply adapted to provide constant current, the heater immediately heated along its entire length to 180° C., the Curie temperature of the ferrite powder placed in spaces 111, and self-regulated at that temperature.

In the above embodiment of this invention, it has also been found that the ferrite powder used to form the ferrite-type body can be any ferrite powder having the desired and magnetic permeability and Curie temperature. The ferrite powder can also be loaded or mixed with copper powder, boron nitride powder or other materials which will enhance the thermal conductivity of the ferrite powder. This promotes a more uniform operating temperature in the ferrite powder. Tests have indicated that loading the ferrite powder with 25% by volume of copper powder does not inhibit the effectiveness of the ferrite powder in coupling with the magnetic field or producing heat by hysteresis losses in the ferrite powder but the presence of the copper powder enhances the thermal conductivity of the ferrite powder and thus improves the thermal efficiency and response of the device. In some cases, however, it is preferred to utilize a highly thermally conductive material which is not electrically conductive, such as boron nitride, available from Union Carbide of Cleveland, Ohio. As will also be recognized, the ferrite powder can be mixed with various components including other fillers, binders and the like. For example, the ferrite can be dispersed in a liquid resin or mixed with a curable material and injected into the void spaces 111 of the coax cable and the binder or resin allowed to cure to hold the ferrite powder in the desired position thus eliminating the necessity of sealing or closing the ends of the coax cable to hold the powder in space 111.

Figure 17B:
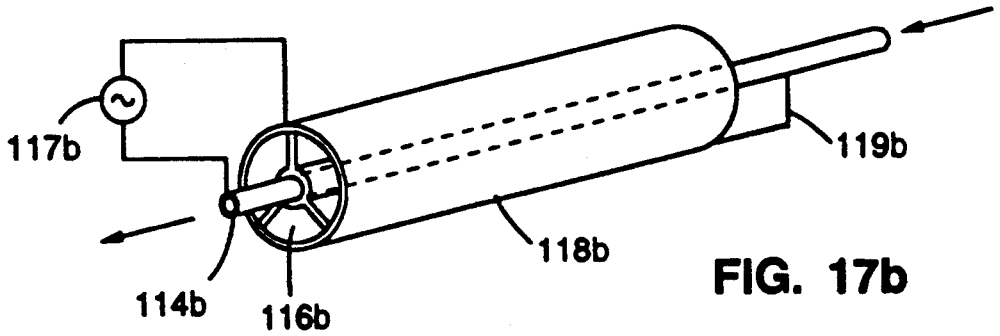

In this regard a related embodiment is illustrated in FIG. 17*b* wherein central conductor 114*b* extending through the center of ferrite-type body 116*b* is a copper tube connected to the appropriate high frequency constant current power supply 117*b* in accordance with the disclosure herein. Ferrite-type body 116*b* is comprised of any desired ferrite-type body having the desired magnetic and Curie temperature properties, which can be as illustrated in FIG. 17*a*. In this embodiment where central conductor means is a hollow copper tube, the device can be powered by connecting power supply 117*b* to center conductor 114*b* and to conductive outer shell 118*b*, where connector 119*b* connects center conductor 114*b* and shell 118*b*. If outer shell 118*b* is not conductive connector 119*b* can be connected directly to power supply 117*b*. In this configuration, the hollow, tubular center conductor 114*b* remains open and unobstructed, whereby materials, such as gas, liquid, fibers, etc. can be passed through tube 114*b* for heating. As will be apparent, this embodiment of the device can be shaped into any configuration desired such as a coil, vessel jacket or heat exchanger. For example, if the device were placed in an environment where a fluid passing through center conductor 114*b* is to be maintained at a minimum temperature, the ferrite body would be inactive as long as the surrounding temperature were above its Curie temperature, but if the surrounding temperature falls below the Curie temperature, the ferrite body 116*b* would produce heat to maintain the liquid passing through center conductor tube 114*b* at a minimum temperature equal to the self-regulated Curie temperature of the device. It is also apparent that this is achieved without the presence of an external induction coil to produce the magnetic field. The heating device illustrated in FIG. 17*b* is particularly efficient because the copper tube center conductor 114*b* produces the maximum magnetic field and maximum hysteresis loss heating in ferrite body 116*b* adjacent to the wall of center conductor tube 114*b*. Thus, the heat transfer into tube 114*b* and into the liquid passing through tube 114*b* is maximized in a most efficient manner. In addition, it is apparent that the ferrite-type body 116*b* can be used otherwise to provide heat to a desired substrate or material or can be covered with a metallic or appropriate coating to provide the desired shielding and heat transfer property for the heater. This coating or covering can also be used as the return path for the current powering the device as in FIG. 17*a*.

Figure 19:
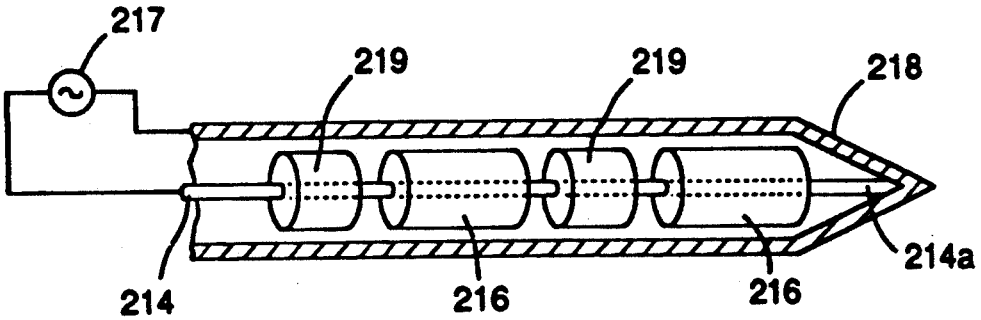
FIG. 19 illustrates an elongate ferrite bead heater embodiment according to the present invention.

FIG. 19 illustrates a self-regulating elongated flexible heater according to the present invention. In this embodiment central conductor 214 extends through the length of the heater and is connected at the opposite end of the heater 214*a* with the flexible conductive metal wire braid 218 which forms the current return path and the external surface of the heater. The flexible braid can be a conventional copper braid which is electrically conductive and has good heat transfer properties. If a flexible construction is not required the braid portion may be replaced by a rigid conductive tube such as copper tubing. Power supply 217 according to the disclosure herein is connected to central conductor 214 and the conductive outer braid 218. Ferrite beads 216 are spaced along center conductor 214 at desired intervals to produce the desired heating or watt density. Ferrite beads 216 can be held in position by any desired means such as by spacers 219 which are electrically insulated but may be either thermally insulated if heat is desired only at the locations of ferrite beads 216 or can be thermally conductive if it is desired to have a more uniform heating along the length of the heater. A device of this type can be made flexible so it can conform to the surface or substrate to be heated by the device. Such a device would be useful in heat tracing applicators previously mentioned.

When elongate heaters according to the present invention are of sufficient length such that they represent a significant portion of the wave length of the alternating current frequently produced by the power supply, there will be null points at each half wavelength distance along the heater due to the AC current having zero potential at those particular points. These points will be observed when the heater of the present invention employs a single central conductor through the ferrite-type body or bodies. However, FIGS. 20*a* and 20*b* illustrate an embodiment of this invention wherein the central conductor is configured and positioned so that the standing wave of the alternating current produced by the power supply will not, in net effect, have any null points or cold spots along the length of the heater. In this embodiment central conductor 314 is passed through ferrite bodies 316 in a u-shape or loop fashion and is connected to a power supply 317 such as disclosed herein. In this particular embodiment the heater shown can be used as is or can be covered with an appropriate heat conductive cover such as a flexible copper braid, provided of course that the central conductor loop 214 is appropriately insulated from a such copper braid covering.

In FIG. 20*b* the wavelength of the power supply to conductor 314 is schematically illustrated (not necessarily to scale) to show that the null point or cold spot in the heater can occur at point "A" where that particular ferrite bead 316 would not receive sufficient power to heat that bead to its Curie temperature. However, due to the loop arrangement of conductor 314 the null points and the standing wavelength on the outgoing and the return loop are offset from each other. This arrangement is achieved by having the end of the loop 314*a* of conductor 314 at the appropriate position along the length of the heater. The heater in essence doubles back on itself so that the standing wave of the alternating current in the two passes of conductor 314 are 90° out of phase. Thus, it can be seen in FIG. 20 that in point "A" where a null or cold spot would normally occur in the outgoing part of the conductor loop is offset by the 90° out of phase current in the return loop. The net effect is that no net null points in the current or cold spots in the heater will occur.

FIG. 21 illustrates another type of embodiment of an elongate heater device according to the present invention. Central conductor 414 is a copper wire inserted into sleeve 416 and connected to power source 417 as disclosed herein. Sleeve 416 is a polymeric tube containing a loading of ferrite particles in the polymer. This type of polymeric sleeve containing ferrite particles is described in co-pending application Ser. No. 07/404,621 and a preferred two particle system thereof is described in co-pending application Ser. No. 07/465,933 U.S. Pat. No. 5,126,521. The tubing or sleeve 416 can be heat recoverable or can be an unexpanded sleeve. If recoverable, the first application of power to central conductor 414 will heat the ferrite particles in the sleeve causing it to shrink onto conductor 414. Thereafter, whenever the power is applied the sleeve heats to the Curie temperature of the ferrite particles and self-regulates at that temperature. This embodiment provides an elongate heater that will locally self-regulate and is useful as a trace heater. As will be apparent, other configurations and embodiments hereof will be apparent; for example, the conductor may be a loop of insulated wire within the sleeve so that power source 417 can be connected to both ends of the device. Or, the central conductor can be a single wire inside a tube, which is doubled back in u-shape to form a heater of two tubes side-by-side arranged to avoid cold spots as indicated above in connection with FIG. 20. Also, the ferrite particles may be present as a layer or coating on the sleeve instead of impregnated in the polymer, as disclosed in application Ser. No. 07/404,621.

FIG. 22 illustrates a rod type heater in which metal tube 518 is sealed at one end and in the other end is inserted central conductor loop 514 having ferrite beads 516 thereon. Conductor 514 is connected to power supply 517. In this embodiment the metal tube, such as a copper tube, is a rod heater which will self regulate at the Curie temperature of the ferrite beads 516. In this configuration the watt-density of the rod heater can be varied with the spacing and size of the ferrite beads. When a metal tube having high thermal conductivity is used, such as copper, aluminum and the like, the rod heater will maintain a uniform temperature along its length, provided that the ferrite beads have the same Curie temperature. In this type of construction the metal tube 518 is electrically isolated from the power supply 517.

Figure 23:
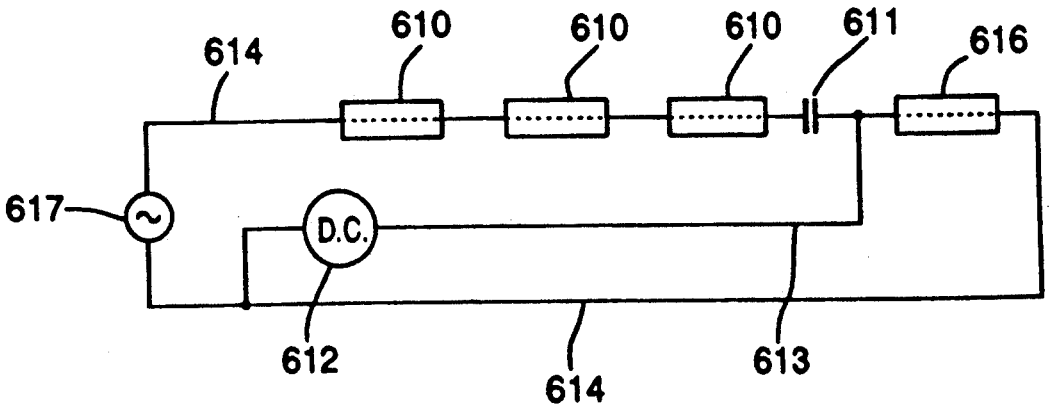
FIG. 23 illustrates an embodiment of the present invention comprising a control means.

FIG. 23 is a schematic diagram of a circuit which illustrates how a heater device according to this invention can be controlled by use of an imposed DC current bias. In this system conductor loop 614 passes through ferrite beads 610 and 616 and is connected to high frequency alternating current power source 617 to form a heater according to this invention. Each ferrite bead or group of beads can be turned off so they do not heat while the current from power supply 617 continues to heat the remaining beads. For example, end bead 616 can be turned off by imposing a DC current from DC power source 612 through conductors 613 and 614. The DC current is isolated from the remaining ferrite beads 610 by capacitor 611. The DC current biases the magnetic field acting on bead 616 and causes the hysteresis losses generated in ferrite bead 616 to diminish so that no heat is generated in the end ferrite bead 616. At the same time the high frequency current continues to heat the remaining ferrite beads 610 through conductor loop 614. Thus, in this embodiment the end ferrite bead 616 can be switched off by imposing a DC current on the conductor passing through the bead, without interrupting the high frequency power source 617 heating of the other ferrite beads in the circuit or device. This effect may be accomplished for any bead at any location by proper arrangement of D.C. biasing source 612 and isolation capacitor 611. This aspect will be useful for maintenance work or for other reasons for which heating in a particular area needs to be temporarily shut down. Or, this aspect can be used to provide actual on/off control for an entire heater without having to turn the high frequency power source off and on. It should be noted that instead of a DC current, the same effect can be achieved by placing a permanent magnet adjacent to the ferrite bead(s) or areas of the heater device to be turned off without turning off the high frequency power source. The permanent magnet has the same effect as the imposed DC bias of flattening the characteristic hysteresis loop of the ferrite-type body thereby diminishing the heat generated by high frequency hysteresis heating, but the remainder of the device continues to produce heat. Using a permanent magnet to disable all or a portion of the heater is non-intrusive and can be accomplished from outside the surrounding heater covering.

As can be recognized from the above embodiments, one skilled in the art may construct heating devices according to the present invention using any desired shape of ferrite body in combination with other magnetic or nonmagnetic materials which either enhance the heat transfer or regulate the heat transfer as desired or can be used to provide the impedance matching and other circuit characteristics as may be desired for a particular device. One skilled in the art will be able to construct self-regulating heating devices from the teaching of the present invention using any conventional shape of ferrite body and using other shapes specifically designed to be used in the present invention. For example, conventional ferrite bodies are available in various sizes and properties and Curie temperature properties in the form of threaded cores, shield beads, Balum and broadband cores, solid or hollow rods which may be round, flat or rectangular, solid or hollow slugs, sleeves, disks, pot cores, toroids, bobbins, u-cores, and the like. As mentioned above, the appropriate ferrite bodies can be selected to construct heating devices according to the present invention based on their Curie temperature, initial permeability, Mu lossiness due to hysteresis losses at the desired high frequency of the power source, impedance properties in the circuit of the device and other properties that will be apparent skilled in the art designing devices according to the present invention.

As noted in the above disclosure and description of the present invention, in addition to having the ferrite-type body having the desired magnetic permeability, lossiness, Curie temperature and other properties, and having the power supply with the appropriate high frequency and preferably constant current output, it is also important to have impedance matching between the power supply and the heater circuit comprising the central conductor and the ferrite-type body or bodies. As will be apparent to one skilled in the art, impedance matching can be obtained in a variety of different ways. In some instances the elongate trace type heaters according to the present invention will have sufficient mass/volume of the ferrite-type body positioned on or around the central conductor or conductors to provide in themselves the sufficiently high impedance to not require any impedance boosting as could be obtained with a transformer or matching network. In those instances where the impedance of the heater circuit itself does not match the impedance of the power supply, the impedance matching can be achieved using various devices and techniques such as capacitors in parallel or series in the appropriate circuit to provide the impedance matching which is desired. It is generally desired and preferred for efficient operation of the heaters of this invention to have a high impedance circuit, i.e., 50 ohms or more.

Figure 24:
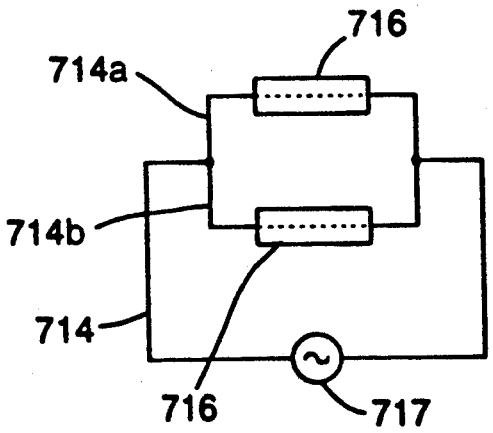
FIGS. 24 and 25 illustrate parallel circuit embodiments of this invention.
Figure 25:
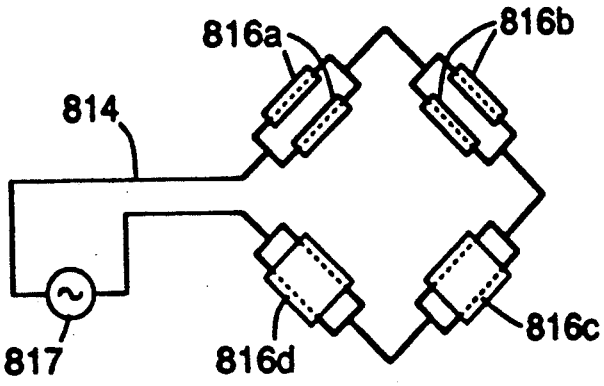

It may be noted that the present invention provides efficient, high watt-density self-regulating heaters and eliminates the need for using multi-turn coils for producing intense magnetic field for induction heating. In addition, it should be noted that the heater elements of the present device will normally be used in a series configuration. If placed in a parallel circuit configuration, as illustrated in FIG. 24, the ferrite bodies 716 present in a parallel circuit may not inherently receive proper current, as they will in a series configuration, thus automatically assuring self-regulated heating at their Curie temperature with respect to other parts of the parallel circuit, unless the parallel circuit design contains sufficient safeguards to assure that the current stays balanced in the parallel sides 714*a* and 714*b* of the circuit. However, parallel configurations can more conveniently be used as illustrated in FIG. 25, where pairs of ferrite beads 816*a*, 816*b*, 816*c* and 816*d* are in parallel in the overall series circuit connected to power source 817. If in each pair of ferrite beads, the two beads are in close physical proximity to function as one heater element, the circuit will remain sufficiently balanced through the two beads. This can be as a result of the two beads always being subjected to the same thermal conditions, or can be a result of the two central conductors through the two beads being sufficiently close that their respective magnetic fields overlap, as beads 816*a* and 816*b* illustrate. Or, this can be the result of parallel conductors through a single bead as beads 816*c* and 816*d* illustrate. In a normal series configuration and with the preferred constant current power supply, the heaters of the present invention are essentially automatically provided with variable power capacity based on receiving constant current at all times. Thus the power generated in any ferrite body present in the series heater circuit will self-regulate at its Curie temperature dependent only on its temperature. In other words, since all of the ferrite bodies receive the same current, their power generation is based solely on their state of impedance, i.e., if they are below their Curie temperature their impedance will be high and the power developed will be high, since power equals the current squared times this resistance, the resistance in this case being proportional to the impedance.

The foregoing general descriptions and descriptions of the specific embodiments fully discloses the general nature of the invention such that others skilled in the art can, by applying current knowledge, readily modify and/or adapt for various applications such specific embodiments without departing from the generic concept of this invention. Therefore, such variations, adaptations and modifications are to be comprehended within the meaning and range of equivalents of the disclosed embodiments. It is to be understood that the phraseology of terminology employed herein is for the purpose of description and not of limitation. The scope of this invention is set forth by the following claims.

I claim:

1. A self-regulating heating device having a ferrite-type body having a Curie temperature, Tc, the device comprising:

central conductor means for carrying a high frequency alternating current and producing a magnetic field around the exterior thereof;

a power supply connected to the central conductor means for supplying the high frequency alternating current to the conductor means at sufficient power to cause the ferrite-type body to heat by internal losses to its Curie temperature; and said ferrite-type body positioned in the magnetic field of the central conductor means and being sufficiently lossy to be capable of producing sufficient heat by internal losses in said magnetic field to raise the temperature of the ferrite-type body to Tc;

whereby the heating device self-regulates at Tc when powered by said power supply at a sufficiently high frequency and at sufficient power to cause the ferrite-type body to heat to Tc by internal losses.

2. A self-regulating heating device according to claim 1 wherein the ferrite-type body comprises a ferromagnetic material which heats by internal losses comprising eddy current skin effect losses.

3. A self-regulating heating device according to claim 1 wherein the ferrite-type body comprises a ferrimagnetic material which heats by internal losses comprising hysteresis losses.

4. A self-regulating heating device according to claim 1 wherein the device further comprises a heat conductive surface means adapted for thermal contact with the ferrite-type body for transferring the heat produced by the ferrite-type body from the ferrite-type body to an object or material to be heated by the device.

5. A self-regulating heating device according to claim 4 wherein the surface means is electrically conductive and is connected to the central conductor means, thereby comprising part of the circuit connected to the power supply.

6. A self-regulating heating device according to claim 1 wherein the central conductor means consists of a single metallic conductor positioned through an internal portion of the ferrite-type body.

7. A heating device according to claim 1 wherein the central conductor means passes twice through an internal portion of the ferrite-type body.

8. A heating device according to claim 1 wherein the central conductor means passes three times through an internal portion of the ferrite-type body.

9. A heating device according to claim 1 wherein the central conductor means passes four times through an internal portion of the ferrite-type body.

10. A self-regulating heating device according to claim 1 wherein the power supply frequency is at least about 10 MHz.

11. A self-regulating heating device according to claim 1 wherein the power supply is adapted to provide constant current to the central conductor means.

12. A self-regulating heating device according to claim 1 wherein the ferrite-type body comprises a ferrite bead.

13. A self-regulating heating device according to claim 1 wherein the ferrite-type body comprises ferrite particles.

14. A self-regulating heating device according to claim 13 wherein the ferrite particles further comprise heat transfer enhancing materials, a binder or a filler.

15. A self-regulating heating device according to claim 14 wherein the particles comprise in combination lossy ferrite particles and non-lossy ferrite particles.

16. A self-regulating heating device according to claim 13 wherein the particles comprise in combination lossy ferrite particles and non-lossy ferrite particles.

17. A self-regulating heating device according to claim 1 wherein the ferrite-type body is positioned around the central conductor means.

18. The self-regulating heating device according to claim 1, wherein said ferrite-type body comprises a plurality of ferrite disks and a plurality of thermally conductive disks interposed between said ferrite disks such that the transfer of heat produced in the ferrite disks to the substrate or material to be heated by the device is enhanced by the thermally conductive disks.

19. A self-regulating heater device comprising:

central conductor means for carrying a high frequency alternating current and producing a magnetic field around the exterior thereof;

a ferrite-type body having a Curie temperature, Tc, positioned in the magnetic field of the central conductor means and being sufficiently lossy to be capable of producing sufficient heat by internal losses in said magnetic field to raise the temperature of the ferrite-type body to Tc; and connector means adapted for electrically connecting said central conductor means to a high frequency alternating current power supply capable of causing the ferrite-type body to heat to Tc by internal losses;

whereby the heater device heats to Tc and self-regulates at Tc when powered by said power supply at a sufficiently high frequency and at sufficient power to heat ferrite-type body to Tc by internal losses.

20. A self-regulating heater device according to claim 19 wherein the device further comprises a heat conductive surface means adapted for thermal contact with the ferrite-type body and for transferring the heat produced by the ferrite-type body from the ferrite-type body to an object or material to be heated by the device.

21. A method of providing self-regulating heating of a substrate or material comprising:

positioning a heater device in thermal proximity to the substrate or material to be heated, wherein the device comprises a ferrite-type body having a central conductor means positioned in the ferrite-type body, having a Curie temperature, Tc, and being capable of producing heat by internal losses in an alternating magnetic field to raise the temperature of the ferrite-type body to Tc; and applying a high frequency alternating current to said central conductor means to produce an alternating magnetic field around the central conductor wherein the frequency is sufficiently high and the power is sufficient to cause the ferrite-type body to heat to Tc in the magnetic field of the central conductor means.

22. A method of providing a self-regulating heating device according to claim 21, comprising applying the current as constant current at a frequency of at least about 10 MHz.

23. A method according to claim 21 comprising positioning the heater device on an electrical device having a soldered component and heating to desolder a soldered component therefrom.

24. A soldering iron tip adapted to melt solder, said soldering iron tip comprising:

at least one heating member formed of a ferrite-type body which is sufficiently lossy when exposed to a magnetic field having a frequency sufficiently high and sufficient power to cause heating of the body by internal losses and which has a predetermined Curie temperature higher than the melting point of the solder; and a central conductor means positioned in the ferrite-type body and adapted to be connected to a power source for providing said high frequency current through said central conductor means, producing said magnetic field around the central conductor and heating said ferrite-type body to its Curie temperature.

25. A soldering iron tip according to claim 24 comprising a metal member on the external surface of the ferrite-type body for contacting the solder and wherein the central conductor means is connected to the metal member and comprising connector means being connected to the central conductor means and the metal member and being adapted for connection to the high frequency power source.

26. A soldering iron tip according to claim 25 wherein the metal member is a metal coating.

27. A soldering iron tip according to claim 24 wherein the central conductor means is u-shaped and passes through the ferrite-type body twice.

28. A soldering iron tip according to claim 24 wherein the tip comprises a tool adapted for placement on an integrated circuit chip carrier and comprises ferrite-type bodies positioned at the perimeter thereof for heating the perimeter of the tool for the melting of solder at the perimeter of the chip carrier.

29. A soldering iron tip according to claim 28 wherein a perimeter portion of the tool comprises a solder wick means for containing molten solder.

30. A soldering iron tip according to claim 24 wherein the central conductor means comprises a hollow tube adapted for removing molten solder.

31. A soldering iron tip according to claim 24, wherein said ferrite-type body comprises a plurality of ferrite disks and a plurality of thermally conductive disks interposed between said ferrite disks such that the transfer of heat produced in the ferrite disks to the solder to be melted by the device is enhanced by the thermally conductive disks.

32. A soldering iron tip according to claim 24 comprising means for impressing a non-alternating bias magnetic field across at least a portion of the ferrite-type body to reduce or eliminate heating in that portion of the ferrite-type body.

33. An elongate self-regulating heater device comprising:

an elongate central conductor means extending the length of the device for carrying a high frequency alternating current and producing a magnetic field around the exterior thereof;

a ferrite-type body having a Curie temperature, Tc, positioned in the magnetic field of the central conductor means and being sufficiently lossy to be capable of producing sufficient heat by internal losses in said magnetic field to raise the temperature of the ferrite-type body to Tc;

elongate surface means positioned on the outside of the ferrite-type body for transferring heat therefrom to the material or substrate to be heated; and conductor means adapted for electrically connecting said central conductor means to a high frequency alternating current power supply capable of causing the ferrite-type body to heat to Tc by internal losses;

whereby the heater device heats to Tc and self-regulates at Tc when powered by said power supply at a sufficiently high frequency and sufficient power to heat ferrite-type body to Tc by internal losses.

34. An elongate self-regulating heater device according to claim 33 wherein the elongate central conductor means is U-shaped and passes through the ferrite-type body twice.

35. An elongate self-regulating heater according to claim 33 wherein the elongate surface means comprises a metal braid.

36. An elongate self-regulating heater according to claim 33 wherein the elongate surface means comprises a metal tube.

37. An elongate self-regulating heater according to claim 33 wherein the elongate surface means is electrically conductive and the elongate central conductor means is connected at the remote end thereof to the elongate surface means.

38. An elongate self-regulating heater according to claim 33 wherein the ferrite-type body comprises an elongate polymeric tube containing ferrite-type material positioned around the elongate central conductor means, the surface of which tube forms the elongate surface means.

39. An elongate self-regulating heater according to claim 33 wherein the elongate central conductor comprises a hollow tube.

40. An elongate self-regulating heater according to claim 33 comprising means for impressing a non-alternating bias magnetic field across at least a portion of the ferrite-type body to reduce or eliminate heating in that portion of the ferrite-type body.

41. An elongate self-regulating heater according to claim 33 which is in the form of an air dielectric coax cable having at least a portion of the air dielectric space filled with a ferrite-type material.

42. A self-regulating heater device comprising:

central conductor means for carrying a high frequency alternating current and producing a magnetic field around the exterior thereof;

a ferrite-type body having a Curie temperature, Tc, positioned in the magnetic field around the central conductor means and being sufficiently lossy to be capable of producing sufficient heat by internal losses in said magnetic field to raise the temperature of the ferrite-type body to Tc; and connector means adapted for electrically connecting said central conductor means of high frequency alternating current power supply capable of causing the ferrite-type body to heat to Tc by internal losses;

whereby the heater device heats to Tc and self-regulates at Tc when powered by said power supply at a sufficiently high frequency and sufficient power to heat ferrite-type body to Tc by internal losses;

wherein the central conductor means comprises a hollow tube adapted for receiving material to be heated.

* * * * *

UNITED STATES PATENT AND TRADEMARK OFFICE

CERTIFICATE OF CORRECTION

PATENT NO. : 5,182,427

DATED : January 26, 1993

INVENTOR(S) : Thomas H. McGaffigan

It is certified that error appears in the above-identified patent and that said Letters Patent is hereby corrected as shown below:

Column 1, Line 29, delete "gasses" and insert --gases-- therefor;
Column 14, line 48, delete "with in" and insert --within-- therefor;
Column 16, line 31, after "4A", delete "." and insert --,-- therefor;
Column 16, line 35, after "herein", delete "." and insert --,-- therefor;
Column 16, line 36, after "wire", delete "." and insert --,-- therefor;
Column 17, line 37, delete "ia" and insert --is-- therefor.

Signed and Sealed this

First Day of March, 1994

Bruce Lehman

*Attest:*

BRUCE LEHMAN

*Attesting Officer*

*Commissioner of Patents and Trademarks*